United States Patent [19]

Yokoyama

[11] Patent Number: 5,040,023

[45] Date of Patent: Aug. 13, 1991

[54] METHOD AND APPARATUS FOR SUPPLYING TONER TO A DEVELOPING DEVICE IN AN IMAGE FORMING APPARATUS

[75] Inventor: Tomoaki Yokoyama, Osaka, Japan

[73] Assignee: Minolta Camera Kabushiki Kaisha, Osaka, Japan

[21] Appl. No.: 406,737

[22] Filed: Sep. 13, 1989

[30] Foreign Application Priority Data

| | | | |
|---|---|---|---|
| Sep. 14, 1988 | [JP] | Japan | 63-231851 |
| Sep. 21, 1988 | [JP] | Japan | 63-238294 |
| Oct. 27, 1988 | [JP] | Japan | 63-272748 |

[51] Int. Cl.[5] ..... G03G 15/00; G03G 15/08

[52] U.S. Cl. ..... 355/208; 355/245; 355/246

[58] Field of Search ..... 355/208, 246, 214, 206, 355/245, 253; 118/653, 665, 688-691

[56] References Cited

U.S. PATENT DOCUMENTS

| | | | |
|---|---|---|---|
| 4,082,445 | 4/1978 | Steiner | 355/246 |
| 4,423,948 | 1/1984 | Kimura et al. | 355/246 |
| 4,589,762 | 5/1986 | De Schamphelaere et al. Y | 355/246 |
| 4,592,645 | 6/1986 | Kanai et al. | 355/206 |
| 4,708,458 | 11/1987 | Ueda | 355/206 |
| 4,814,820 | 3/1989 | Hirahara et al. | 355/253 |

FOREIGN PATENT DOCUMENTS

| | | | |
|---|---|---|---|
| 51-144236 | 12/1976 | Japan . | |
| 56-113170 | 9/1981 | Japan | 355/245 |
| 60-256168 | 12/1985 | Japan | 355/246 |
| 61-55673 | 3/1986 | Japan | 355/208 |
| 63-110474 | 5/1988 | Japan | 355/246 |

*Primary Examiner*—Joan H. Pendegrass

*Attorney, Agent, or Firm*—Willian Brinks Olds Hofer Gilson & Lione

[57] ABSTRACT

A device for replenishing a developing device with a toner is disclosed, which device is for use in electrophotographic image forming equipment such as a copying machine or a printer. The replenishment of the developing device with the toner is executed when the toner concentration in the developer held in the developing device decreases below a prescribed reference concentration. Otherwise, this replenishment is effected supplementarily when the ratio of the dark part to the bright part of the image on a given document to be printed exceeds a prescribed reference value and, at the same time, the equipment is set for a copying mode in which the toner is consumed quickly. This mode consists in causing the copying action to be performed continuously, allowing the copying operation to be performed on copying papers of a size larger than a prescribed reference size, or reproducing an image in a high density. Since the replenishment of the toner is attained under a prescribed condition even when the toner concentration in the developer exceeds a prescribed reference concentration, the image forming equipment is enabled to reproduce an image of high quality on a copying paper even under the condition in which the toner is quickly consumed.

41 Claims, 18 Drawing Sheets

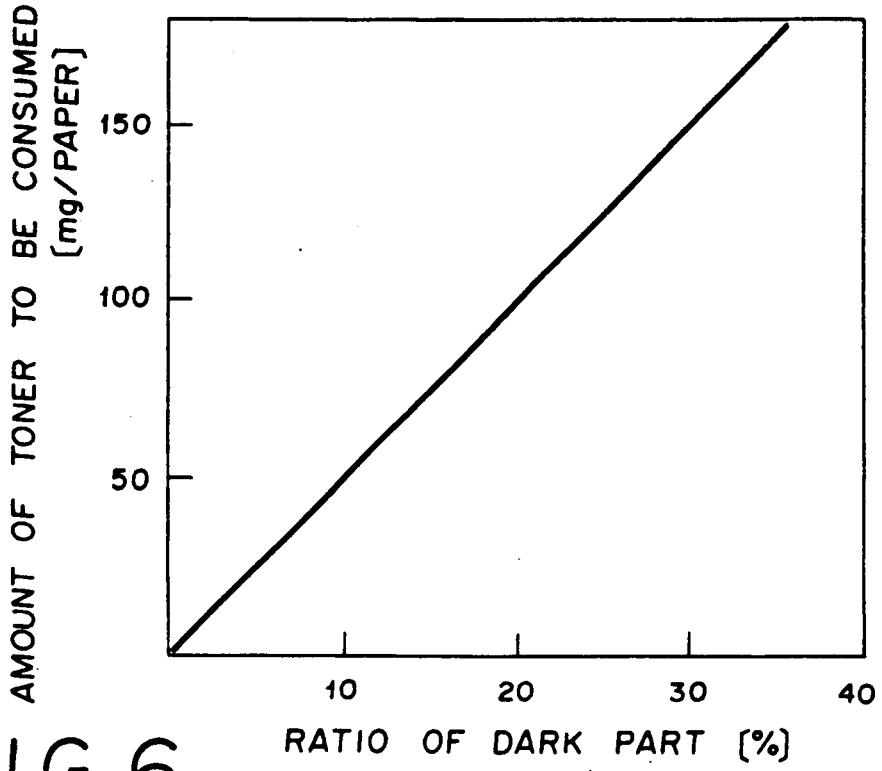
FIG.6
FIG.7
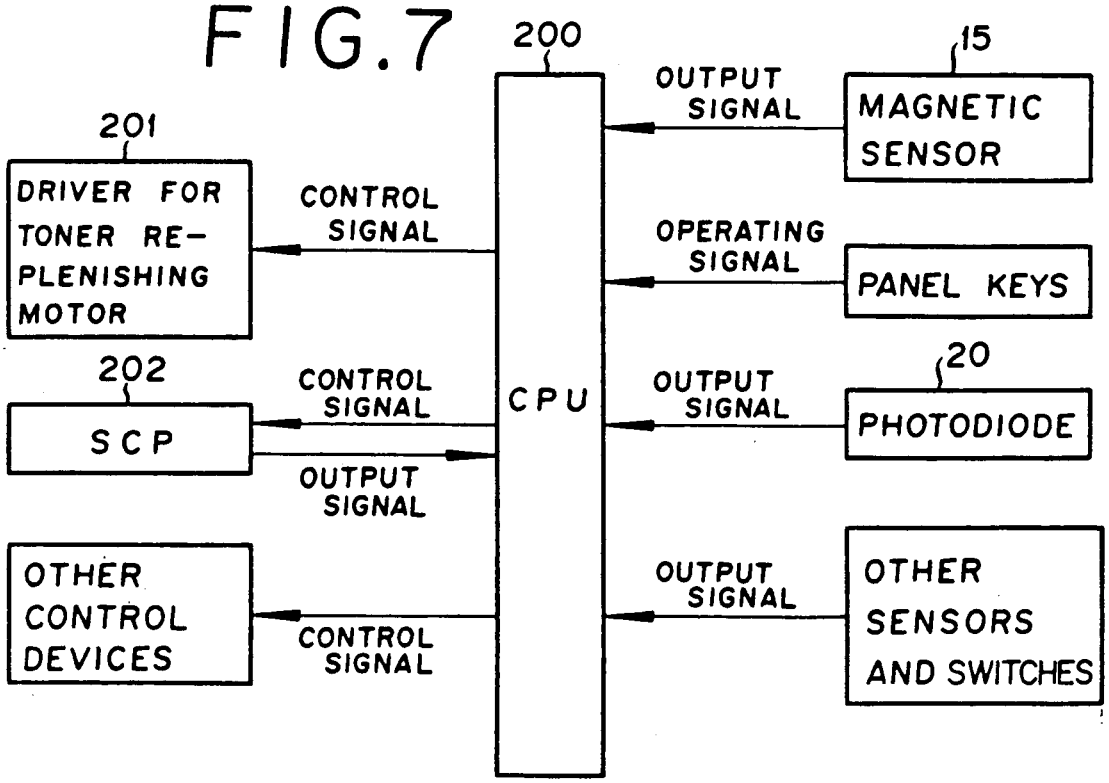

MEASUREMENT OF IMAGE RATIO
S4

PRESCAN START FLAG=1 ?
NO
YES
S401
SETTING OF AMOUNT OF EXPOSURE
S402
TIMER T START
S403
PRESCAN START FLAG←0
PRESCAN FLAG←1
S404
PRESCAN FLAG=1 ?
NO
YES
S405
TIMER T TURNS UP ?
NO
YES
S406
SAMPLING OF DATA
S407
PRESCAN 180mm ?
S408
YES
NO
CALCULATION OF SAMPLING DATA
S410
TIMER T START
S409
RETURNING OF SCANNING SYSTEM
S411
PRESCAN FLAG←0
ESTIMATION FLAG←1
S412
RETURN

METHOD AND APPARATUS FOR SUPPLYING TONER TO A DEVELOPING DEVICE IN AN IMAGE FORMING APPARATUS

BACKGROUND OF THE INVENTION

1. Field of the Invention

This invention relates to an image forming apparatus using an electrophotographic process. More particularly, this invention relates to improvement in and concerning a method for the supply of toner to a developing device.

2. Description of Related Art

An image forming apparatus such as a copying machine or a printer which uses the electrophotographic process incorporates therein a developing device adapted to supply a toner from the toner replenishing tank containing the toner for the purpose of developing an electrostatic latent image formed on the surface of a photosensitive medium.

Particularly, the image forming apparatus of the type designed to use a two-component developer consisting of a toner and a carrier is required to keep the ratio of the toner to the carrier (toner concentration) in the developer within a stated proper range. The developing device, therefore, is adapted to supply a prescribed amount of the toner from the toner replenishing tank whenever the toner concentration in the developer falls below a prescribed level.

U.S. Pat. No. 4,592,645 discloses one example of what may be termed a toner concentration controlling device, which is adapted to discern the toner concentration in the developer by detecting the permeability of the developer by means of a sensor disposed in the developing device and comparing the detected value of the permeability with a reference value.

Another device of the so-called automatic image density control (AIDC) method which discerns the toner concentration in the developer by forming an electrostatic latent image of a reference pattern on a photosensitive medium, developing this latent image, and detecting the image density of the developed image with a photosensor and effects the supply of toner whenever the detected toner concentration falls below a prescribed level has been widely know.

FIG. 19 is a cross-sectional model diagram illustrating a typical developing device using a two-component developer and FIG. 20 is a model diagram illustrating the movement of the developer in the developing device and the consumption of the toner. In these diagrams is depicted the developing device which effects the development of a latent image by the magnetic brush developing method. This developing device has a first screw vane 16, a bucket roller 11, and a developing sleeve 6 incorporated in a casing 3 sequentially in the order mentioned in the direction toward a photosensitive drum 1. These component parts are adapted to be driven jointly by one motor (not shown). The first screw vane 16 is possessed of a multiplicity of semicircular spiral parts and is rotated counterclockwise. The bucket roller 11 is possessed of a multiplicity of L-shaped vanes extending in the radial direction and a second screw vane 13 and is rotated clockwise. The developing sleeve 6 is located outside a magnet roller 7 fixed and not allowed to rotate and is rotated clockwise. In the casing 3, a partition board 5 is disposed between the first screw vane 16 and the bucket roller 11. At the opposite terminals of this partition board 5, notches **5*a*, 5*b* are formed as illustrated in FIG. 20**.

In the developing device described above, the toner from the toner supply part (not shown) is supplied to above one terminal part of the first screw vane 16. By the bucket roller 11, the developer which has been already used for development is passed through the notch **5*a* formed at one terminal of the partition board 5 and returned to the screw vane 16. It is then stirred in conjunction with the replenishing toner and, at the same time, conveyed in the direction of the arrow by the screw vane 16**. At this time, the toner in transit is charged to a prescribed polarity owing to the friction with carrier particles.

The developer thus conveyed is stirred and is supplied into the bucket roller 11 through the notch **5*b* formed at the other terminal of the partition board 5. Here, the developer is stirred by the vanes 14 owing to the rotation of the bucket roller 11 and is moved by the magnetism of the magnet roller 7 in the direction of the outer periphery of the sleeve roller 6. The toner is consumed by being deposited by means of the sleeve roller 6 on the electrostatic latent image formed on the outer peripheral surface of the photosensitive drum 1. The developer as accompanied by the consumption of the toner is conveyed to the lefthand end part in the view of FIG. 20 by the second screw vane 13 disposed inside the bucket roller 11 and then supplied through the notch 5*a* onto the first screw vane 16. In this manner and as illustrated in FIG. 20, the developer is circularly moved along a conveying path formed jointly by the first screw vane 16, the second screw vane 11, and the notches 5*a*, 5*b***. During the course of the conveyance of the developer, the toner is consumed and replenished.

In the developing device described above, since the replenishment of the toner is effected whenever the fall of the toner concentration below the prescribed reference value is detected, this toner replenishment is fated to be repeated and the toner is supplied in a large amount at once where the toner is consumed quickly and copiously as in the continuous copying of an image on a large number of copying papers. As a result, the toner is not sufficiently dispersed in the developer and some of the toner escapes being fully charged by friction with the carrier and remains to be a poorly charged toner. The occurrence of this poorly charged toner entails the phenomenon of feeble attachment of toner to the white background of a copying paper (hereinafter referred to as "toner fog") and the problem that the toner is scattered inside the copying device to defile the interior of the device and smear the copying paper.

If the amount of the toner to be supplied at a time is set at a relatively small level for the purpose of precluding the problem mentioned above, then the supply of toner cannot keep abreast with the consumption of toner and the toner concentration in the developer decreases and the density of the developed image proportionately dwindles. There consequently arises the problem that the carrier is suffered to adhere to the photosensitive drum.

Where a subject copy to be copied under the condition of very quick consumption of toner happens to contain an image whose density is varied very widely from one portion to another, the amount of the toner to be consumed heavily varies locally on the copying paper and consequently the toner concentration is varied inside the developing device between the portion having a large toner consumption and the portion having a small toner consumption, possibly with the result that the developed image betrays uneven distribution of density.

In the developing device described above which causes the toner to be conveyed in one direction from the part in which the toner has been received, since the toner is gradually consumed as the developer is moved from one end to the other of the developing device by the second screw vane 13 as illustrated in FIG. 19, inherently the toner concentration is higher in the right-hand part than in the lefthand part of the bucket roller 11 in the bearings of FIG. 20. In FIG. 20, for example, even if the righthand end part of the photosensitive drum 1 has a proper image density, the lefthand end part thereof constitutes itself a region for a low image density. Under the condition involving quick consumption of the toner, therefore, the concentration of the toner attached to the outer peripheral surface of the developing sleeve 6 varies widely between the opposite end parts and, as a result, a inclination occurs in the density of the developed image.

The toner concentration inside the developing device is not evenly increased promptly in response to the replenishment of toner. In the developing device of this kind, therefore, it has been customary for the toner to be replenished in a prescribed amount at prescribed intervals. To be specific, after the toner is supplied by way of replenishment in the prescribed amount, the developer is stirred and conveyed for a prescribed time and then the toner replenishment is repeated based on the detection of the toner concentration. When the toner replenishment is carried out solely with the fixed timing under the condition involving quick consumption of the toner as described above, however, the replenishment of toner is made after the toner concentration is considerably lowered from the reference value and, as a result, the width of variation of the toner concentration in the developer is suffered to increase.

SUMMARY OF THE INVENTION

A primary object of this invention is to provide an improved toner replenishing device.

A further object of this invention is to preclude inferior toner charging which occurs when the toner is supplied in a large amount at once to the developing device.

Another object of this invention is to provide an image forming apparatus such that the amount of the toner in the developing device is not decreased to an extent of unduly diluting the density of the image formed on the copying paper even when the toner is quickly consumed.

Still another object of this invention is to provide a developing device which is capable of thoroughly stirring and conveying the developer even under the condition involving quick consumption of the toner.

Yet another object of this invention is to provide for the developing device a toner replenishing device such that the toner concentration in the developer is sparingly varied even when the toner is consumed quickly.

A still further object of this invention is to provide a toner replenishing device incapable of any excessive replenishment of toner.

In accordance with the present invention, there is provided a toner replenishing device for use in an electrophotographic image forming apparatus comprising a developing device for developing an electrostatic latent image formed on a photosensitive medium with a developer containing a toner, toner concentration detecting means for detecting the toner concentration of the developer in the developing device, toner replenishing means for replenishing the developing device with the toner, image ratio detecting means for detecting the ratio of the dark part of an image to be printed, first controlling means for controlling the toner replenishing means so as to effect the replenishment of the toner when the toner concentration is below a prescribed reference value, and second control means for actuating the toner replenishing means so as to effect the toner replenishment when the operating condition of the image forming apparatus fulfils a prescribed condition and, at the same time, the ratio of the dark part of the image exceeds a prescribed ratio and even when the toner concentration is not less than the reference value.

In accordance with the present invention, there is also provided, an electrophotographic image forming apparatus comprising a developing device for developing an electrostatic latent image on a photosensitive medium with a developer, supplying means for supplying the developer in the developing device to the photosensitive medium, conveying means for conveying the developer in the developing device along the supplying means, driving means for driving the conveying means, and switching means for switching the driving speed of the conveying means in a plurality of steps.

In accordance with the present invention, there is further provided, an electrophotographic image forming apparatus comprising: a developing device for developing an electrostatic latent image on a photosensitive medium with a developer, toner concentration detecting means for detecting the toner concentration in the developer within the developing device, means for making a decision with a prescribed cycle as to whether or not the toner concentration is not more than a prescribed reference value, replenishing means for replenishing the developing device with the toner when the toner concentration determined in consequence of the decision made by the judging means is not more than the prescribed reference value, image ratio detecting means for detecting the ratio of the dark part of an image to be formed, and controlling means for causing the cycle of the decision made by said judging means to be smaller than usual when the operating condition in the image forming equipment fulfils a prescribed condition and, at the same time, the ratio of the dark part of the image is not less than a prescribed reference value.

BRIEF DESCRIPTION OF THE DRAWINGS

FIG. 6 is a graph showing the relation between the ratio of a dark part in the image of an original and the amount of toner consumed.

FIG. 7 is a schematic block diagram illustrating a control circuit of the aforementioned copying machine.

DESCRIPTION OF THE PREFERRED EMBODIMENTS

Figure 1:
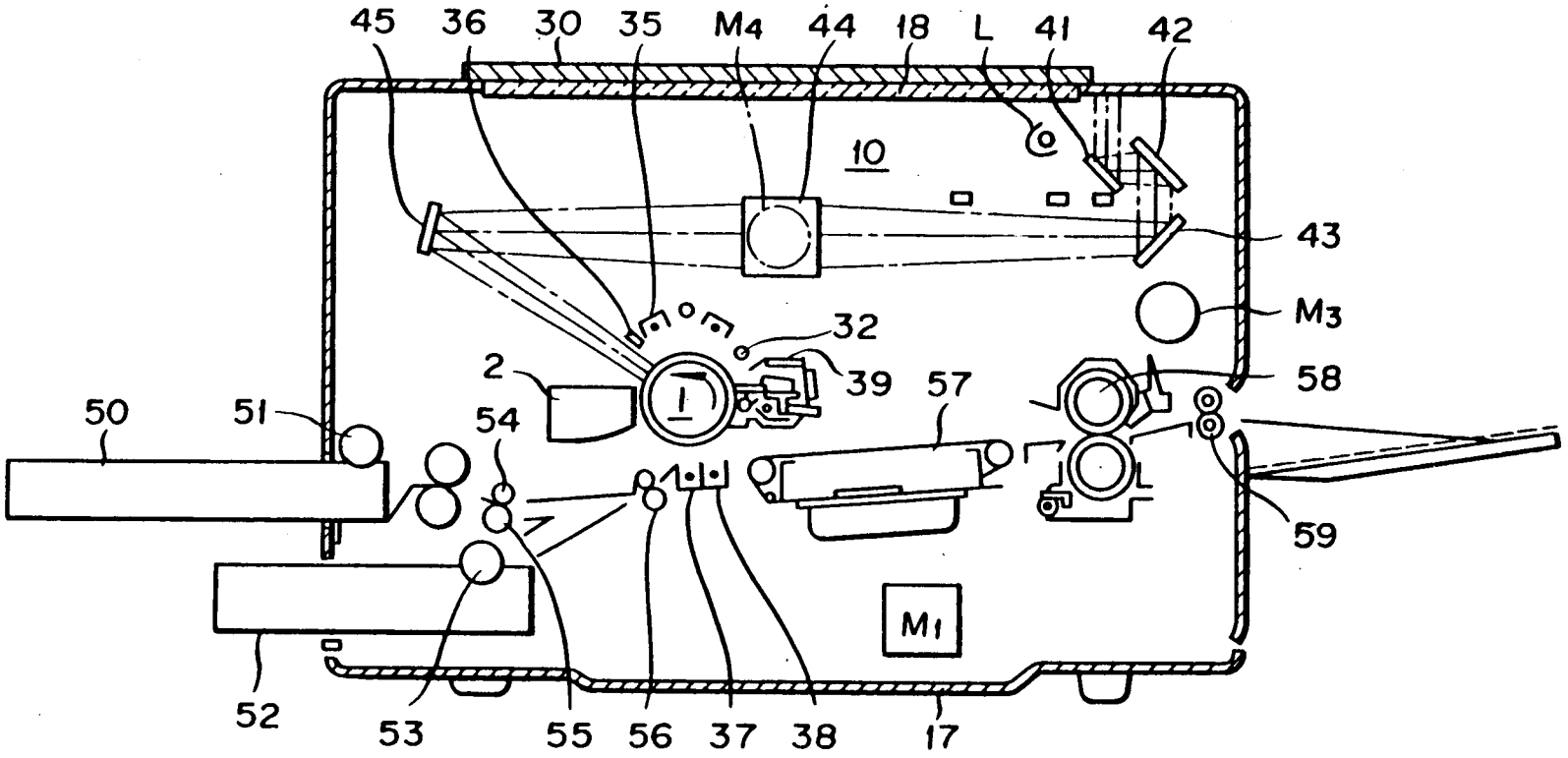
FIG. 1 is a schematic diagram illustrating the internal structure of a typical copying device as the first embodiment of this invention.

As illustrated in FIG. 1, a photosensitive drum 1 rotated counterclockwise by a main motor M1 is disposed substantially in the central part of a housing 17 of a copying machine. Around this photosensitive drum 1, a blade type cleaning device 39, an eraser lamp 32, a charger 35, an in-between image eraser 36, and a developing device 2 are disposed. The cleaning device 39 removes the part of the toner which remains on the outer peripheral surface of the photosensitive drum 1 after the operation of transfer is completed. The photosensitive drum 1 has a photosensitive layer formed on the peripheral part thereof. The part of the surface of this photosensitive layer which has passed the eraser lamp 32 and the charger 35 is uniformly charged thereby and are now exposed to the light projected through a given image by an optical system. The in-between image eraser 36 is composed of a multiplicity of LED elements arranged parallel to the direction of the axis of the photosensitive drum 1. The light projected from the in-between image eraser 36 prevents wasteful consumption of the toner by eliminating the charge outside the effective image forming region of the photosensitive drum 1.

The optical system 10 serves the purpose of scanning a document mounted on a document table 18 made of a transparent material from under the document table. It is provided with a light source L, movable mirrors 41, 42, and 43, a lens 44, and a stationary mirror 45. The peripheral speed of the photosensitive drum 1 is set at 150 mm/sec., for example, and this peripheral speed is invariable when the copying involves no magnification or when it involves a magnification. The light source L and the movable mirror 41 are driven by a DC motor M3 and are moved in the left direction in FIG. 1 at a rate of V/m (m for the magnification of copying) relative to the peripheral speed, V, of the photosensitive drum 1, whereas the movable mirrors 42, 43 are moved in the left direction at a rate of V/2m. This scanning of the image of the document by the optical system 10 results in exposing the photosensitive drum 1 to the image and consequently forming a corresponding electrostatic latent image thereon. To this electrostatic latent image, the toner is made to adhere by the developing device 2.

The housing 17 of the copying machine is provided in the lefthand end part thereof with paper feeding parts 50, 52. The copying papers held inside the paper feeding parts 50, 52 are paid out respectively by paper feeding rollers 51, 53. A conveying route path for guiding copying papers is jointly formed of paired rollers 54, 55, a timing roller pair 56, a conveyor belt 57, a fixing device 58, and a discharge roller pair 59. The timing roller pair 56 serves the purpose of adjusting the timing of the conveyance of the copying paper from the paper feeding part to the photosensitive drum 1 with respect to the region of the toner imager formed on the photosensitive drum 1. A transfer charger 37 for transferring the toner image adhering to the outer peripheral surface of the photosensitive drum 1 onto the copying paper and a separation charger 38 for separating the copying paper from the photosensitive drum 1 are disposed as juxtaposed to the timing roller pair 56. The copying paper which has been peeled off the surface of the photosensitive drum 1 by the separation charger 38 is forwarded through the conveyor belt 57 and brought to the fixing device 58. By this fixing device 58, the toner transferred onto the copying paper is thermally fixed. Then, the copying paper is discharged out of the image forming apparatus by the discharge roller 59.

Figure 2:
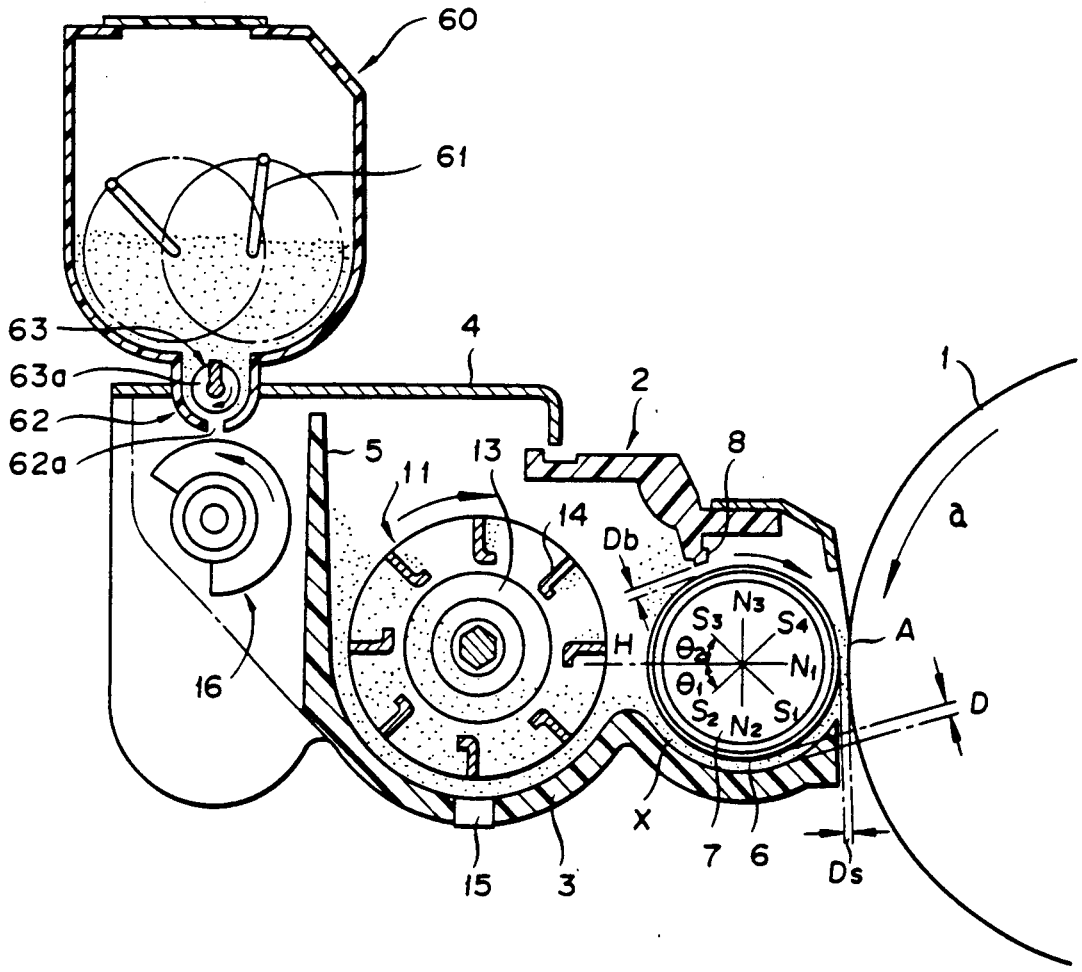
FIG. 2 is a schematic cross section illustrating in detail a developing device shown in FIG. 1.

The developing device 2 is illustrated as magnified in FIG. 2. As illustrated in FIG. 2, inside the casing 3 of the developing device 2, a first screw vane 16, a bucket roller 11, and a developing sleeve 6 are disposed sequentially in the order mentioned in the direction toward the photosensitive drum 1. The casing 3 is provided with a cover 4. A toner replenishing tank 60 is disposed above one terminal part of the first screw vane 16.

Figure 3:
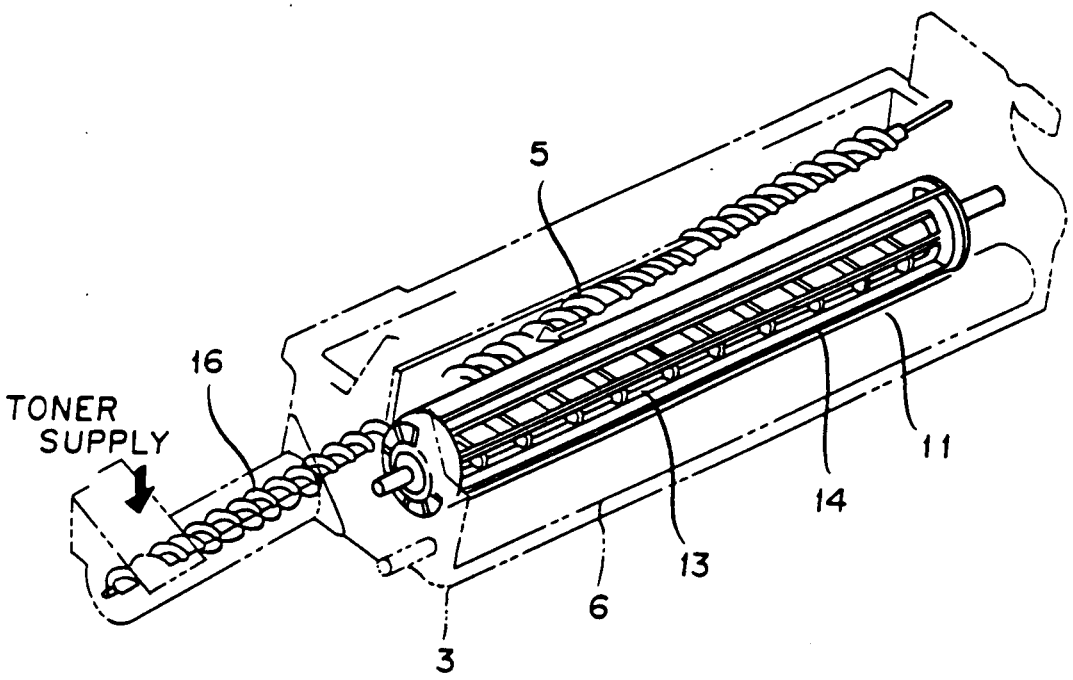
FIG. 3 is a schematic perspective view illustrating a first screw vane and a bucket roller shown in FIG. 2.

FIG. 3 is a diagram illustrating the first screw vane 16 and the bucket roller 11. In this diagram, the casing 3 and the developing sleeve 6 are indicated with an imaginary line. As illustrated in FIG. 3, the first screw vane 16 is possessed of a multiplicity of spiral blades, which are partly cut off in the direction of the axis so as to assume the shape of sectors as illustrated in FIG. 2. This first screw vane 16, owing to the counterclockwise rotation thereof, enables the toner supplied from the toner replenishing tank 60 to the lefthand terminal part in FIG. 3, namely the foreground side part to be conveyed to the righthand terminal part, namely the recessed side part as mixed and stirred with the developer. In the present embodiment, the two-component developer consisting of the toner and a magnetic carrier is used.

The bucket roller 11, as illustrated in FIG. 2, is provided in the central part thereof with the second screw vane 13 and in the outer peripheral part thereof with a multiplicity of vanes 14 of an L-shaped cross section disposed radially as extended parallel to the axis of the vane 13. These vanes 14 are severally connected at the opposite terminal parts thereof to the second screw vane 13 and are rotated clockwise in conjunction with the second screw vane 13. The first screw vane 16, the bucket roller 11, and the developing sleeve 6 are rotationally driven jointly by the main motor M1 illustrated in FIG. 1. As the vanes 14 are revolved, they scoop the toner and convey it to above the sleeve roller 6, with a result that the developer is caused to form its chain between the magnetic pole S3 and the magnetic pole N3 on the sleeve roller 6. The bucket roller 11 serves the purpose of not only conveying the toner in the upper part thereof but also stirring the developer in the lower part thereof. Further, owing to the rotation of the second screw vane 13, the developer is conveyed from the righthand terminal part to the lefthand terminal part in FIG. 3. The casing 3 of the developing device 2 is provided at the position below the bucket roller 11, for the purpose of detecting the toner concentration in the magnetic carrier, with a magnetic sensor 15 capable of detecting the permeability of the developer.

Inside the casing 3, a partition board 5 is disposed between the first screw vane 13 and the bucket roller 11. This partition board 5 is provided at the position thereof corresponding to the opposite terminal parts in the axial direction of the bucket roller 11 with notches (not shown). Through the medium of these notches, the first screw vane 16 and the second screw vane 13 of the bucket roller 11 form a path for circulative conveyance of the developer.

The toner from the toner replenishing tank 60 is supplied to the lefthand terminal part of the first screw vane 16 in FIG. 3. In the meantime, by the rotation of the second screw vane 13, the developer is conveyed to the lefthand terminal part of the vane 13 and is returned through the notch at the lefthand terminal part of the partition board 5 back to the first screw vane 16. To the lefthand terminal part of the first screw vane 16, therefore, the developer whose toner concentration has been lowered in consequence of the toner consumption and the freshly supplied toner are forwarded. They are mixed and stirred and conveyed to the recessed side part owing to the rotation of the first screw vane 16. The developer which has been conveyed to this part is passed through the notch formed in the righthand terminal part of the partition board 5 and conveyed to the righthand terminal part of the bucket roller 11. The developer which has been supplied to the bucket roller 11 is conveyed by the second screw vane 13 in the direction of the lefthand terminal part and, during the course of this conveyance, enabled to supply the toner to be consumed at the photosensitive drum 1.

The developing sleeve roller 6 incorporates therein a magnetic roller 7 which is provided on the outer peripheral part thereof with a plurality of magnetic poles. This magnetic roller 7 is fixed to the casing 3 and is not allowed to rotate. By the magnetism of the magnetic roller 7, the developing sleeve 6 is enabled to retain the developer on the outer peripheral surface thereof and the developer supplied from the bucket roller 11 is conveyed to the developing region A opposed to the photosensitive drum 1. In this region, the toner is deposited on the electromagnetic latent image formed on the photosensitive drum 1 to effect the development.

The magnetic roller 7 is provided on the outer peripheral part thereof with magnetic poles N1 to N3. In the intervening spaces between these magnetic poles are disposed magnetic poles S1 to S4. The magnetic poles S2 and S3 of the same polarity are disposed above and below the portion of the magnetic roller 7 which is opposite to the developing region A and nearest to the bucket roller 11. The magnetism is nulled between the magnetic poles S2 and S3 and no developer is retained on the portion of the outer peripheral surface of the developing sleeve 6 corresponding to this region. As a result, the developer which has reached the position below the developing sleeve 6 is returned to the bucket roller 11.

In the upper part of the casing 3, a doctor blade (chain height regulating plate) 8 is disposed opposite the developing sleeve 6 as extended in the direction parallel to the axis of the developing sleeve 6. This doctor blade 8 serves the purpose of cutting off the chains of developer conveyed by the developing sleeve 7 and consequently regulating the amount of the developer to be conveyed.

The toner replenishing tank 60 is intended to replenish the developing device 2 with the toner. Slightly below the central part of this toner replenishing tank 60, as illustrated in FIG. 2, a stirring rod 61 adapted to preclude the phenomenon of cross-linking or blocking is rotatably disposed. This tank 60 is provided in the lower part thereof with a replenishing part 62 possessed of an opening part **62*a* for supply of the toner. Through this opening part 62*a*, the toner is dropped. The replenishing part 62 incorporates therein a toner replenishing roller 63 which is provided on the rotary shaft thereof with a spiral vane 63*a*. The vane 63*a* has the direction of its twist reversed halfway along the central part in the axial direction thereof as the boundary. Owing to this setup, the toner inside the tank 60 is gathered in the central part of the roller 63 and is allowed to fall down through the opening part 62*a* which is located below the central part. The stirring bar 61 and the toner replenishing roller 63 are adapted to be synchronously driven by a motor (not shown). Thus, the toner of the amount proportionate to the amount of rotation of the roller 63 is supplied through the opening part 62*a* to the terminal part of the first screw vane 16**.

Figure 4:
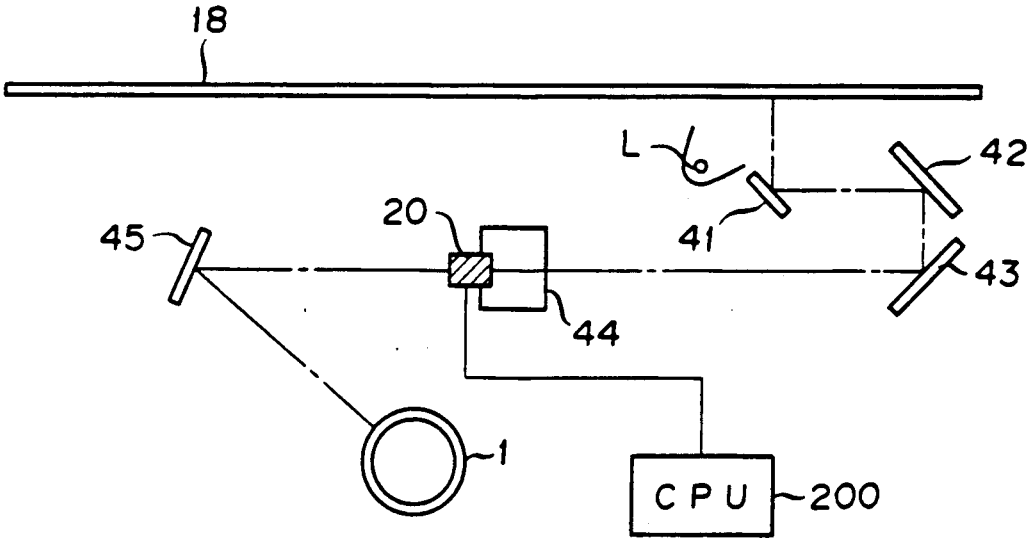
FIG. 4 is a schematic diagram of an optical system in the copying device shown in FIG. 1.

The replenishment of the toner is effected, when the toner concentration in the developer to be determined based on the permeability detected by the magnetic sensor 15 is judged to have fallen below the reference concentration, by causing the motor for the toner replenishment to be driven for a prescribed time. In the illustrated embodiment, the amount at which the scanning system composed of the light source L and the movable mirrors 41, 42, and 43 turns on the switch (not shown) disposed beside the document table 18 constitutes itself the timing for starting the replenishment of the toner. The toner replenishment is effected once per each scanning of a subject copy. The frequency and condition of the toner replenishment need not be limited to those just mentioned but may be freely set as occasion demands. The amount of the toner to be replenished once in response to the judgement of the toner concentration is set at 200 mg in the present embodiment FIG. 4 is a schematic diagram of an optical system for projecting the image of a document on the photosensitive drum 1. A photodiode 20 is disposed beside the lens 44, namely outside the path of the light passing through a lens 22. In this embodiment, when a print button (to be described fully hereinafter) for starting the copying operation is operated, a preliminary scanning is performed on the image of the document before the copying operation is started, in order for the photodiode 20 to measure the amount of the light reflected from the surface of the document through the medium of the mirrors 41, 42, and 43. The information thus acquired is forwarded to a microprocessor (hereinafter referred to as "CPU") 200 for the determination of the ratio of the dark part to the bright part of the surface of the image of the original document.

Figure 5:
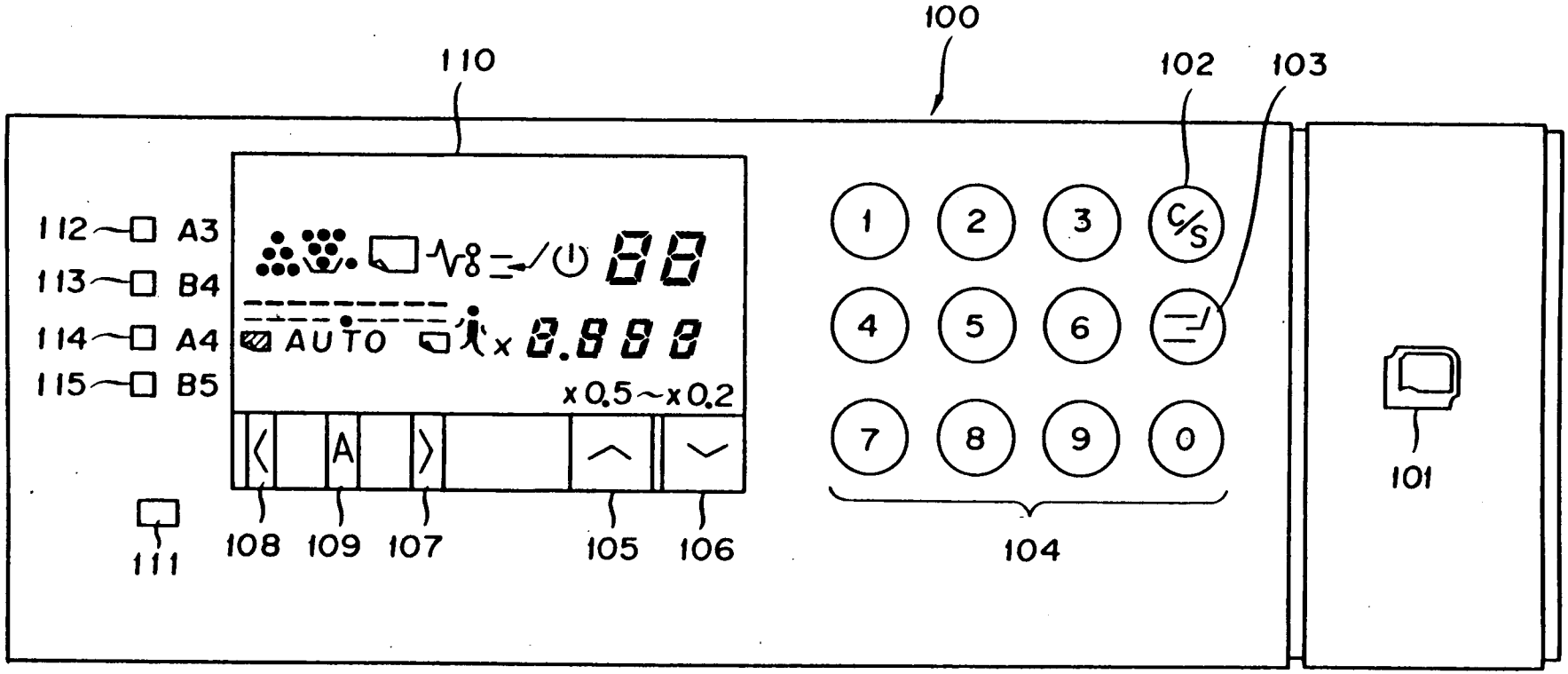
FIG. 5 is a plan view illustrating an operation panel of the copying machine shown in FIG. 1.

The housing 17 of the copying machine is provided in the upper part thereof with an operation panel 100 illustrated in FIG. 5. On this operation panel 100 are disposed a print start switch 101 adapted to issue a command to start the copying operation, a clear-stop switch (C/S key) 102 for stopping the copying operation either immediately after the start of the copying operation or during the course of multi-copy (continuous copying of the image of one document on a plurality of copying papers) and, at the same time, clearing the set number of copying papers and resetting the standard mode "1", a switch 103 for interrupted copying, a ten-key pad 104 for setting the number of copying papers used for one and the same image, an up-switch 105 and a down-switch 106 for setting the number of copying papers to be used, a concentration down switch 107 and a concentration up switch 108 for adjusting the density of the image, an automatic concentration adjusting switch 109, a paper feeding part selecting switch 111 for selecting between the upper paper feeding part 50 and the lower paper feeding part 52, paper size displaying LEDs 112 to 115 for displaying the paper size of the selected paper feeding part, and a display part 110 for displaying the condition of copying and the status of the copying machine.

In the present embodiment, the question as to whether or not the copying operation to be started entails quick consumption of the toner is determined on the basis of the copying conditions which the operator introduces through the switches on the operation panel 100. Now, the copying conditions which involve the quick consumption of the toner will be described below.

A. Continuous copying

The term "continuous copying" as used herein refers to the case in which the image on one document is to be continuously copied on a plurality of copying papers. When the copying is to be made on 100 copying papers, for example, the amount of the toner to be consumed per unit time is large in the continuous copying as compared with the copying which is performed with a certain interval interposed between successive copying papers. In the present embodiment, the continuous copying to be made on five or more copying papers is judged to involve quick consumption of the toner.

In the copying machine which is provided with an automatic document feeder adapted to effect continuous conveyance of sheet documents to the document table 18, the number of copying papers is set similarly or dissimilarly when the copying machine is operated for copying a plurality of documents one each on the copying papers and when it is operated for continuously copying one document on a plurality of copying papers. When the copying is to be performed on a larger number of copying papers than the preset number, it suffices to effect the prescribed control by assuming the condition of copying involving quick consumption of the toner.

B. Copying on copying papers of large size

Where the image on a given document is to be copied in the same ratio as the document on the copying papers, the amount of the toner to be consumed increases in proportion as the size of the copying papers increases as shown in Table 1. In this embodiment, it is judged that the copying condition involving quick consumption of the toner arises when the copying papers of the size, A3, are used. The size of copying papers to be used is either manually selected by the operator attending the operation panel or automatically on the basis of information on the size of a document and the degree of magnification of copying. The copying machine may be designed so as to discern the occurrence of the copying condition involving quick consumption of the toner also in the case of magnified copying, depending on the size of the document or the condition of copying magnification. Table 1 shows the relation between the size of copying paper and the amount of toner to be consumed. The amount of toner consumed is expressed in the denomination of mg/paper, on the assumption that the area ratio of the dark part of the image is 6%.

C. Designation of high image density

TABLE 1

| Size of paper | A5 | B5 | A4 | B4 | A3 |
|---|---|---|---|---|---|
| Amount of toner consumed | 15 | 22.5 | 30 | 45 | 60 |

When the adjustment of the image density is set for a high level of density, the amount of the toner to be consumed per paper is larger than usual. In the present embodiment, when a density higher than the standard density is set by the manipulation of the density up switch 108 on the operation panel 100, the occurrence of the copying condition involving quick consumption of the toner is discerned. In the copying machine of the present embodiment which is capable of adjusting the image density in a number of levels, the occurrence of the copying condition involving quick consumption of the toner is judged when the image density is set three levels higher than the standard density, for example. In the copying machine which is possessed of a function of automatic density adjustment, the machine may be designed so as to discern the occurrence of the copying condition involving quick consumption of the toner when the image density set by the operator is higher than the density automatically set by the aforementioned function of automatic density adjustment.

In the present embodiment, the control of the replenishment of the toner is carried out without reference to the toner concentration in the developer when the copying operation is performed under any one of the plurality of copying conditions involving quick consumption of the toner.

It should be noted, however, that where the area ratio of the dark part of the image on a given document is extremely small, the amount of the toner to be consumed per paper is so small as to preclude the possibility of the toner being quickly consumed even when the copying is made continuously or when the copying is made on copying papers of a large size. In this case, if the replenishment of the toner is carried out at all notwithstanding the toner concentration in the developer is higher than the standard level, then the amount of the toner replenished surpasses the amount of the toner consumed and the toner concentration abnormally increases consequently, with a possible result that part of the toner is charged insufficiently and the so-called "toner fog" arises and the toner is scattered inside the apparatus.

In the present invention, therefore, the copying machine is controlled so as to carry out the replenishment of toner when the copying machine is put on the condition involving quick consumption of the toner and, at the same time, the ratio of the dark part of the image on the document detected by the photosensor 20 exceeds a prescribed standard value. This replenishment of the toner, in the present embodiment, is carried out by the timing of the toner replenishment described above and the amount of the toner to be replenished is set at 20 mg at a time.

The standard value of the ratio of the dark part of the image on the original mentioned above is desired to be set so that the amount of the toner consumed during the normal copying operation at that ratio does not fall below the amount of the toner replenished under the copying condition involving quick consumption of the toner.

FIG. 6 shows the relation between the ratio of the dark part of the image when the copying is carried out at the standard image density on copying papers of the size, A4, and the amount of the toner consumed per paper.

In the present embodiment, since the amount of the toner consumed per round of copying, namely, the amount of the toner consumed per copying paper, is 20 mg, the standard value of the ratio of the dark part is set at 4% on the basis of the characteristic diagram of FIG. 6. Since this standard value is variable with the amount of the toner to be consumed per copying paper, the size of the copying papers, and the copying conditions such as image density, this standard value may be varied so as to suit the prevalent copying conditions at the actual time of copying. Thus, the control of the replenishment of toner can be effected more properly by causing the standard value mentioned above to be varied so as to suit the relevant copying conditions.

FIG. 7 is a diagram illustrating in schema a control of the operation of the copying machine of the illustrated embodiment. As illustrated in FIG. 7, this control circuit is possessed of a CPU 200. The output signal of the magnetic sensor 15, the signals of the operation of the keys installed on the operation panel 100, the output signal of the photodiode 20, and the output signals from the sensors and switches installed in various parts of the copying machines are introduced through the input port of the CPU 200. Through the output port of the CPU 200, control signals are issued to a driver 201 for the toner replenishing motor, a scan control processor (hereinafter referred to briefly as "SCP") 202 for controlling the operation of the scanning system, and the other control devices. From the SCP 202, the information concerning the conditions of control in response to the control signals is transmitted to the CPU 200.

Figure 8:
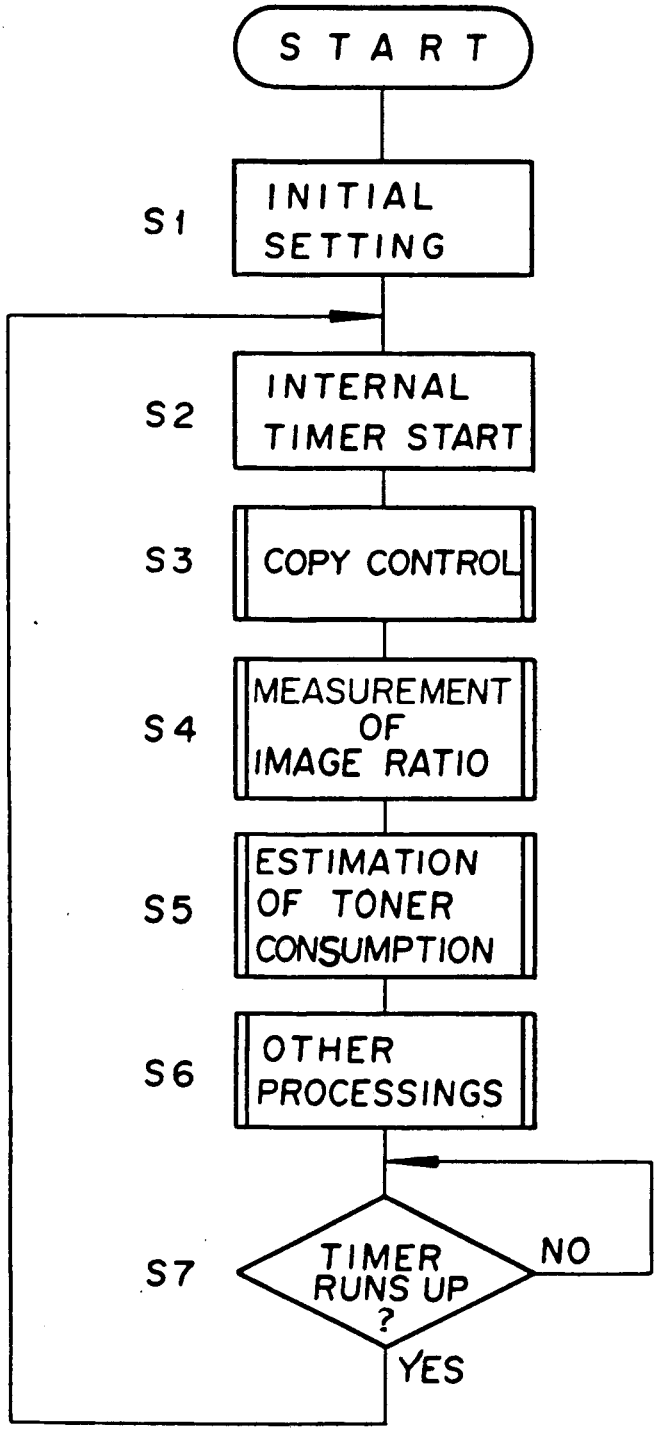
FIG. 8 is a main flow chart illustrating the procedure for the control of the copying machine.

FIG. 8 is a flow chart illustrating the main routine of the CPU. In preparation for the description of this flow chart, the term "on edge" will be defined. This term "on edge" refers to the change of condition which occurs when the conditions of switch, sensor, signal, etc. are changed from the status of OFF to that of ON.

When the power source connection is closed and the program is started, various registers, copy modes, etc. are set to their respective initial state at Step S1. Then at Step S2, an internal timer for fixing the length of one routine is started. Consequently, a sub-routine for copy control which will be specifically described herein below is executed at Step S3, a sub-routine for the measurement of the ratio of image at Step S4, a sub-routine for the estimation of the toner consumption at Step S5, and a sub-routine for other processings at Step S6 respectively. The operation is returned to Step S2 after the internal timer runs up at Step S7.

Figure 9:
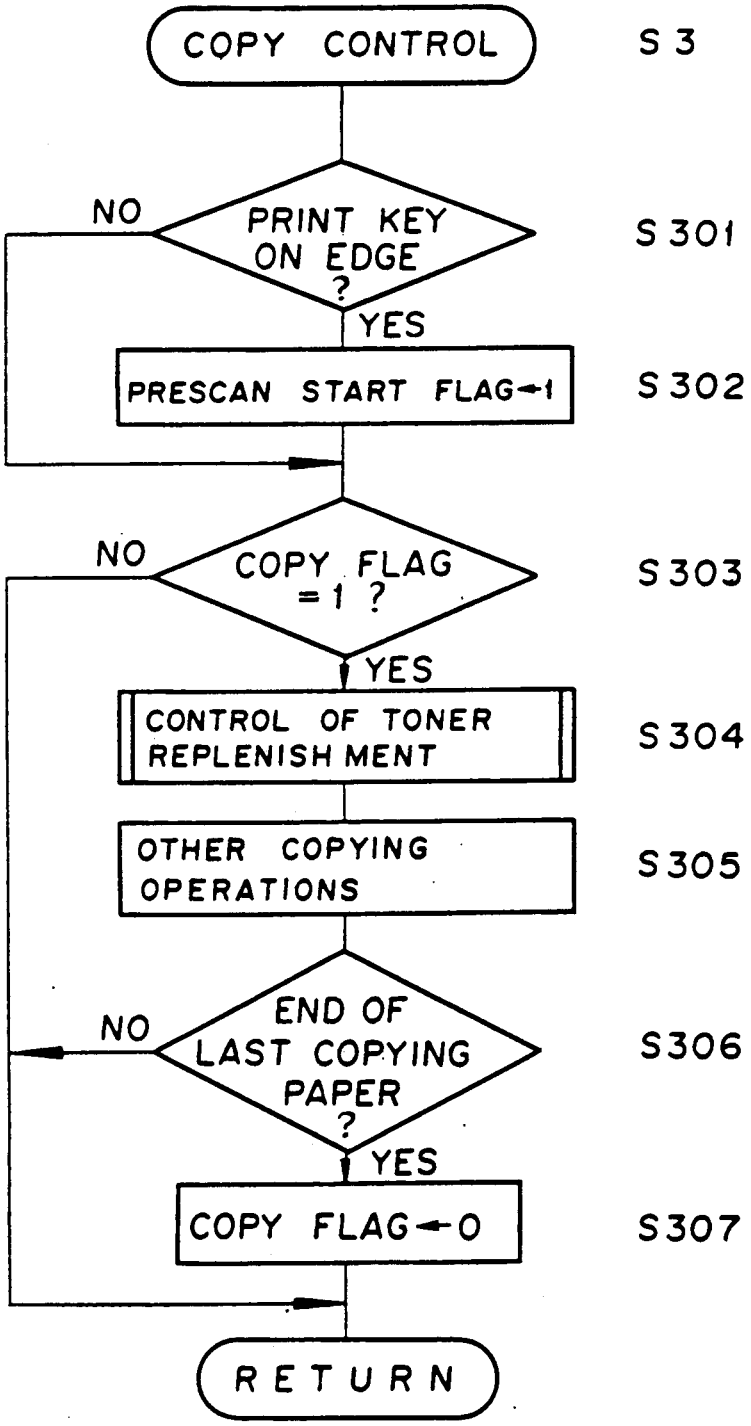
FIG. 9 is a flow chart illustrating a copy-controlling subroutine shown in FIG. 8.

FIG. 9 is a flow chart illustrating in detail the sub-routine for the aforementioned copy control. First, Step S301 decides whether or not the print key 101 has been turned on. When the decision is in the affirmative, Step S302 sets a prescan start flag for starting the prescan to "1". Step S303 executes decision as to the copy flag and, when the decision has "0" as a result, effects a return of the operation. This copy flag designates the copying operation in process. As described specifically herein below, this flag is set to "1" after the prescan is completed and the decision as to the control of the toner replenishment has been made on the basis of the copying conditions prevalent at the present time and the ratio of the dark part of the image on the document. When the status of the copy flag is "1," the processing for the control of the toner replenishment (FIG. 12) which will be specifically described herein below will be executed at Step S304. Subsequently, various copying operations involving the paper feeding part, the paper passing part, the optical system, and the image forming process are controlled (Step S305). When the copying is completed on the last copying paper (Step S306), the copy flag is reset to "0" (Step S307).

Figure 10:
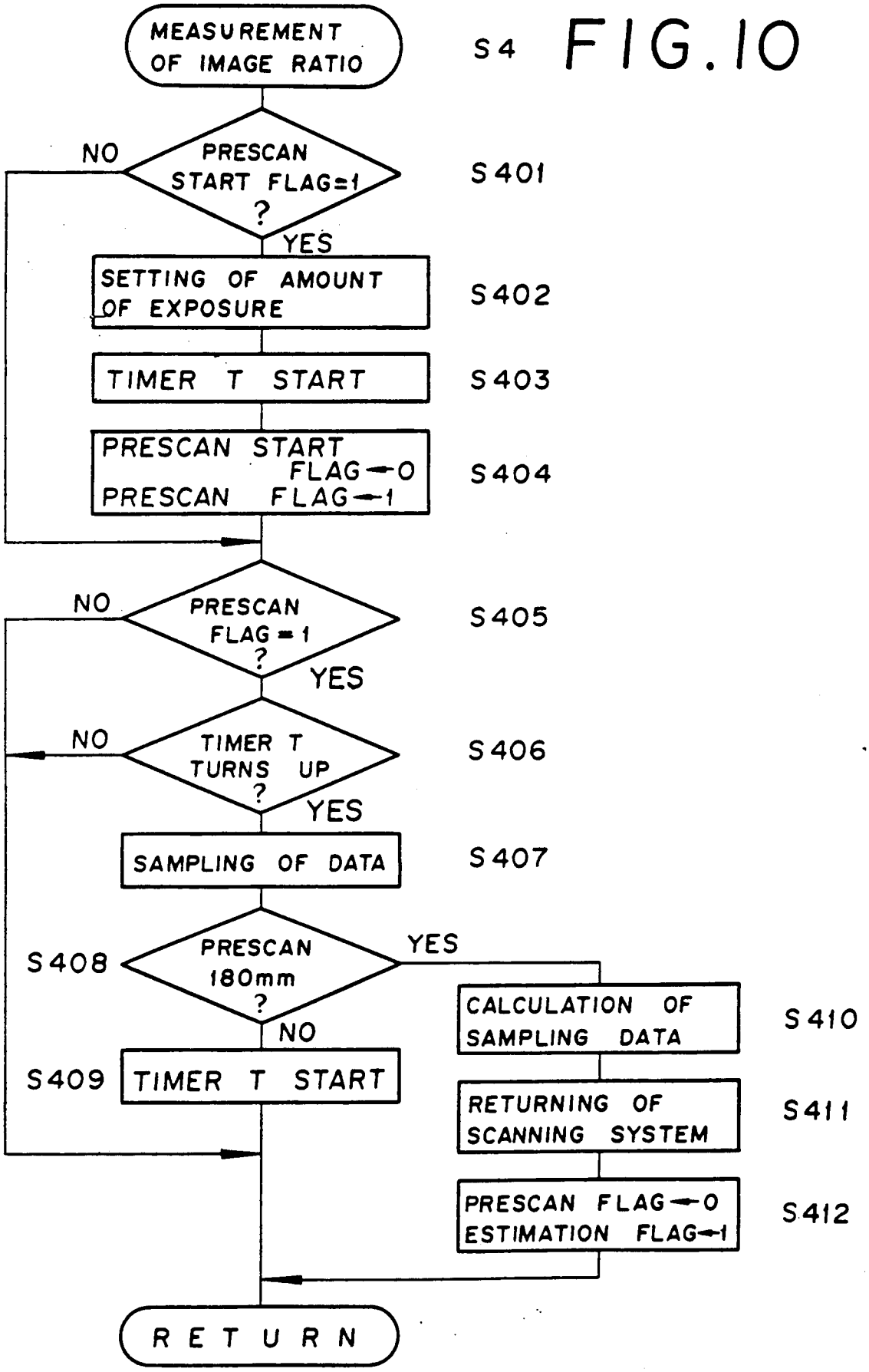
FIG. 10 is a flow chart illustrating an image ratio-measuring subroutine shown in FIG. 8.

FIG. 10 is a flow chart illustrating the processing of the sub-routine for the measurement of the image ratio. In preparation for the description of the individual processings, the method for the measurement of the image ratio (ratio of the dark part of the image) will be described. In the present embodiment, the ratio of the dark part of the image is determined in accordance with the information which is obtained by projecting a prescribed amount of light on a given document and measuring the average value of the amount of reflected light by means of the photodiode 20. More specifically, the average value is obtained by carrying out a prescan in a length of 180 mm on the document, dividing the 180-mm prescan into sections of 5 mm, measuring the amount of the reflected light in each of these sections, and averaging the amounts consequently found. Let X1, X2, . . . , X36 stand for the amounts of reflected light in the sections, and the average amount of light, Xa, is represented by the following formula.

$$Xa = \sum_{i=1}^{36} Xi/36$$

Then, the CPU 200 reads out of a ROM (not shown) the data on the ratio of the dark part of the image corresponding to the data on the average amount of light, Xa and, in the processing of the sub-routine for the estimation of the toner consumption which will be specifically described hereinafter, compares the data on the dark place with the standard value (which corresponds to the ratio, 4%, of the dark place in the present embodiment), and executes the control of the toner replenishment in accordance with the result of this comparison.

With reference to FIG. 10, the decision as to whether or not the prescan start flag has been set to "1" is made at Step S401. When the prescan start flag has been set to "1", the amount of exposure is set at Step S402 so that the amount of light from the exposure lamp equals the prescribed amount of light for the prescan. Then, a timer T is started at Step S403. This timer T is set to the time which is required for the scanning system to make a 5-mm movement during the course of prescan. Then, the prescan start flag is set to "0" and the prescan flag for indicating the fact that the prescan is in process is set to "1" respectively at Step S404. The signal for representing the status of this prescan flag is transmitted to the SCP (FIG. 7) for controlling the operation of the scanning system so as to start the prescanning operation when the prescan flag is turned to "1". When the timer T runs out (Step S406) while the prescan flag remains at "1" (Step S405), sampling of the data Xi obtained by the detection with the photodiode 20 is executed at Step S407. The decision as to whether or not the prescan has been completed throughout the entire length of 180 mm is made at Step S408. If this decision is in the negative, the timer T is started again (Step S409). After the prescan has been completed on the entire length of 180 mm, the data of the aforementioned sample is calculated and the ratio of the dark part of the image is determined at Step S410 and the signal for returning the scanning system is transmitted at Step S411 and, thereafter, the prescan flag is reset to "0" and the flag for estimation of the toner consumption is put up (Step S412).

The judgment on the distance of the prescan is executed directly by the SCP 202. When the prescan distance totals 180 mm, the information of this fact is transmitted from the SCP 202. This decision at Step S408 may be effected by installing a microswitch beside the document table and causing the scanning system to turn on this microswitch. In the present embodiment, the distance for the prescan operation is set at 180 mm. In the case of the copying machine which is provided with means for detecting the size of a given document, the measurement can be attained with a further improved accuracy by causing the entire area of a given document to be scanned without reference to the size of the document and consequently determining the ratio of the dark place. It is otherwise permissible to determine the size of copying papers to be used and allow the prescan to be carried out proportionately to the size so found.

Figure 11:
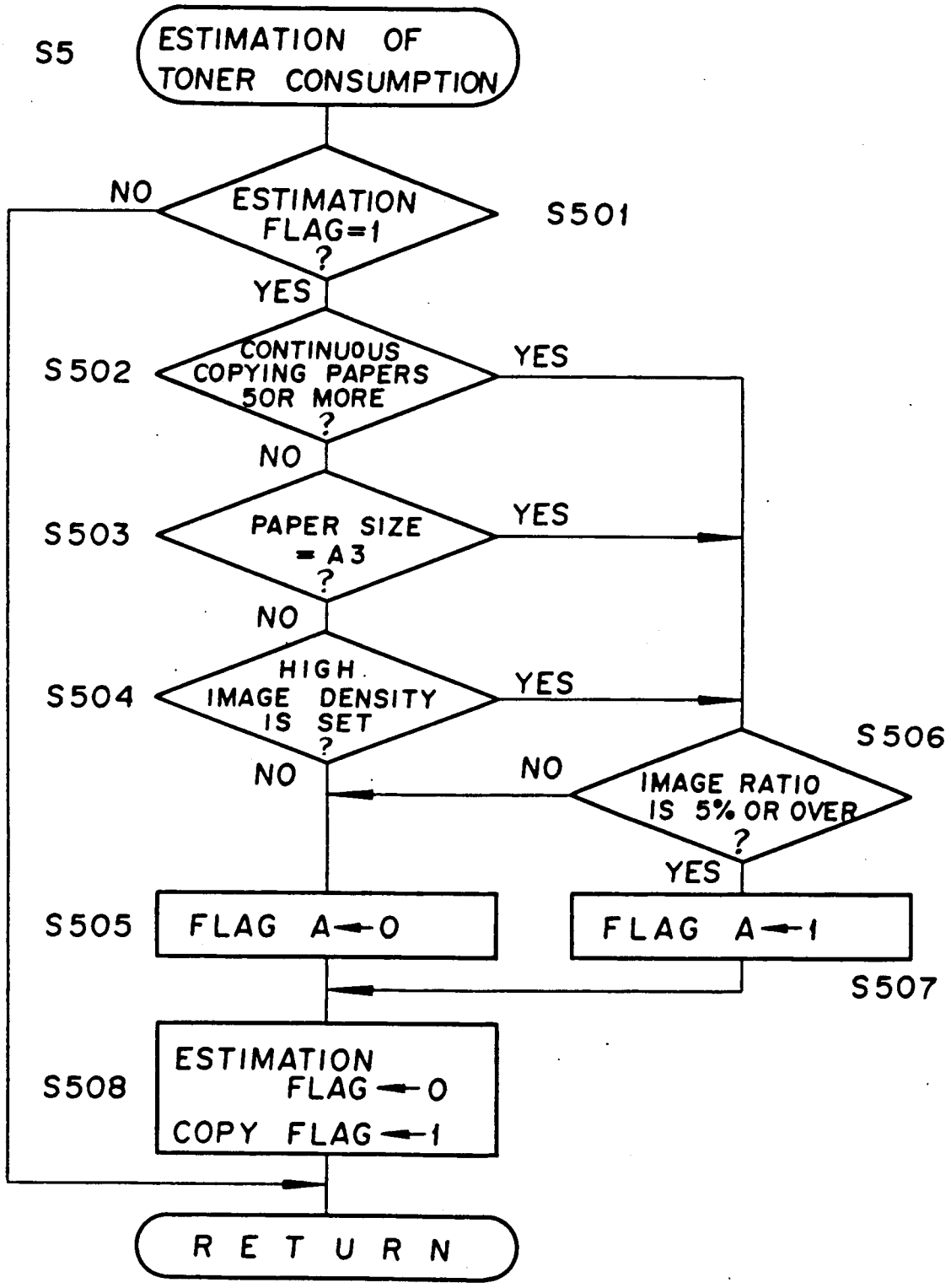
FIG. 11 is a flow chart illustrating a toner consumption-estimating subroutine shown in FIG. 8.

FIG. 11 is a flow chart illustrating in detail the subroutine for the estimation of the toner consumption. When the toner consumption estimation flag is "1" (Step S501), the decision as to whether or not the number of copying papers for continuous copying is 5 or more is made at Step S502, the decision as to whether or not the size of copying papers to be used is A3 at Step S503, and the decision as the whether or not the image density is set at a level higher than the standard density at Step S504. Where none of these decisions draws an affirmative answer, a flag A indicating the fact that the copying conditions involved quick consumption of the toner is set at "0" at Step S505. Where any of the decisions made at Steps S502 to S504 is in the affirmative, the decision as to whether or not the ratio of the dark place of the image on a given document found by the processing for the measurement of the ratio of image is 4% or over at Step S506. When the decision is in the affirmative, the flag A mentioned above is set to "1" at Step S507. Where the decision is in the negative, the flag A is set to "0" (Step S505). Thus, after the estimation of the toner consumption has been effected, the toner consumption estimation flag is reset to "0" and the copy flag to "1" at Step S508. Thereafter, the processings at Steps S304 and S305 as illustrated in FIG. 9 are executed and the operation of copying is started as soon as the scanning system returns to the home position.

Figure 12:
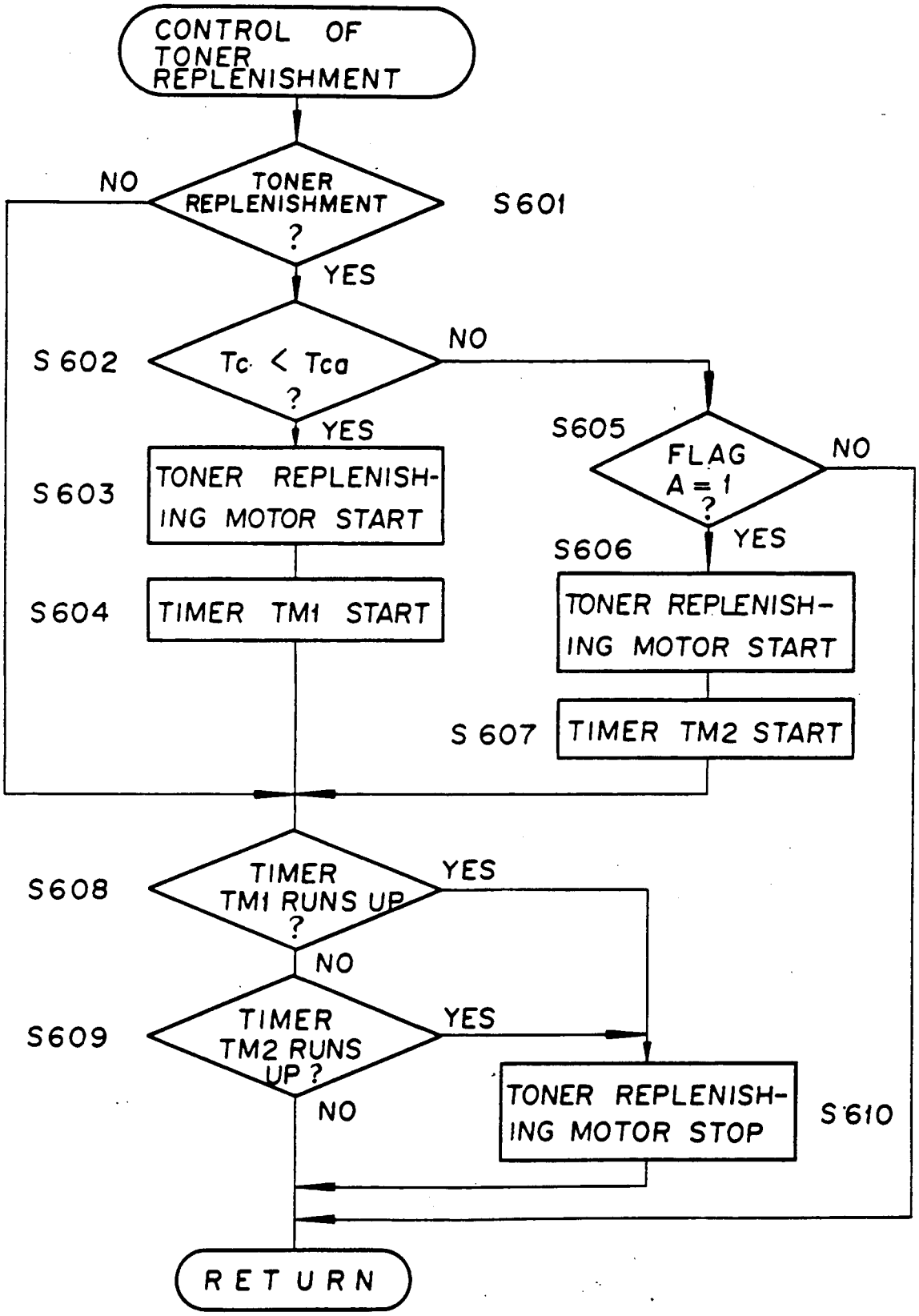
FIG. 12 is a flow chart illustrating a toner replenishment-controlling subroutine shown in FIG. 9.

FIG. 12 is a flow chart illustrating in detail the control of the toner replenishment at Step S304 shown in FIG. 9.

The decision as to whether or not the timing for toner replenishment is ripe is made at Step S601. When this decision is in the affirmative, the toner concentration, Tc, in the developer detected by the magnetic sensor 15 and the reference toner concentration, Tca, are compared at Step S602. When the toner concentration, Tc, is smaller than the reference concentration, Tca, the replenishment of the toner is started by setting the toner replenishing motor operating at Step 603 and, at the same time, the timer TM1 is started at Step S604. The timer TM1 is intended to regulate the time for the operation of the toner replenishment. The supply of the prescribed amount, 200 mg, of the toner is accomplished by the toner replenishing motor continuing its operation until the timer TM1 runs up. When the decision made at Step S602 indicates that the toner concentration, Tc, is higher than the reference concentration, Tca, the aforementioned decision concerning the flag A is executed at Step S605. When the flag A is "0", the replenishment of the toner is not effected and the operation is returned to the initial step. When the flag A is "1", the toner replenishing motor is set operating at Step S606 and the timer TM2 is started at Step S607. In this timer TM2 is set the time for continuing the replenishment of the toner by the operation of the toner replenishing motor. The termination of the operation of the timer TM1 is discerned at Step S608 and that of the timer TM2 at Step S609 respectively. The toner replenishing motor is stopped at the time that the operation of either of the timers TM1 and TM2 is terminated (Step S610).

The replenishment of the toner based on the prediction of quick consumption of toner is fulfilled without reference to the toner concentration Tc. It is carried out for each of the copying papers especially when the condition $Tc \geqq Tca$ is satisfied in the present embodiment. The amount of the toner to be used for the replenishment, therefore, is desired to be set at a level generously smaller than the amount of the toner replenished during the period where the toner concentration is lowered. By so doing, the occurrence of "toner fog" or the scattering of insufficiently charged toner can be precluded without entailing the sharp change in the toner concentration due to the supply of the toner in a large amount in a short span of time.

In the illustrated embodiment, the replenishment of the toner on the prediction of very quick consumption of the toner is depicted as being carried out in a unit amount of 20 mg per copying paper. When the amount of the toner used for the replenishment in one round, the timing of the replenishment, and the frequency of the replenishment are varied so as to suit the amount of the toner estimated to be consumed under the prevalent copying conditions, the control of the replenishment of the toner can be carried out with enhanced accuracy.

In the present embodiment, the replenishment of the toner is executed when any one of the factors, i.e. the number of copying papers, the size of the copying papers, and the image density fulfils the relevant specified condition and, at the same time, the ratio of the dark part of the image exceeds the prescribed value. The condition for executing the replenishment of the toner is desired to be properly set so as to suit the performance of the apparatus and the condition of use. As concerns the number of copying papers, for example, the operation of the replenishment of the toner may be adapted so as to be continued so long as the number of copying papers remaining after each copying action is greater than the prescribed number. The amount of the toner to be consumed can be predicted more accurately by rating the amount of the toner consumed stepwise with respect to various copying conditions as, for example, by comprehensively evaluating the amount of the toner consumed so as to effect the actual replenishment of the toner in respect of the ratio of the dark part of the image on a given subject copy so long as the number of copying papers for continuous copying exceeds 5 even when the copying papers to be used have a size of A4 and the image density is set at the standard level. The standard value of the ratio of the dark part of the image can be accurately controlled by adapting this standard value so as to be varied with the other conditions.

Further, in the present embodiment, the prediction of the ratio of the dark part of the image has been depicted as being attained by allowing the prescan to precede the relevant copying action. Instead of carrying out this prescan, the ratio of the dark part of the image may be calculated at the same time that the copying action is made and, when the prevalent copying condition involves consumption of a large amount of the toner and, at the same time, the ratio of the dark part of the image exceeds the prescribed level, the actual replenishment of the toner may be executed with the timing of the toner replenishment for the copying on the next copying paper. It is alternatively permissible to execute the toner replenishment on the condition of continuous copying on two or more copying papers and carry out the measurement of the ratio of the dark part during the copying on the first copying paper. These modifications have no use for the prescan and, therefore, allow a reduction in the time for copying.

The sensor for the measurement of the ratio of the dark part and the method for determination by the use of this sensor need not be limited to those illustrated in the present embodiment. In the copying apparatus possessed of a function of automatically adjusting the image density through detection of the density of the image on a given document, for example, the number of sensors to be used can be decreased and the cost can be proportionately cut by having the sensor for the measurement of the ratio of the dark part used concurrently as the sensor for the detection of the density of the image on the subject copy. In the digital type copying apparatus which electrically reads the image of a given document by the use of a photoelectric conversion element such as the CCD, the ratio of the dark part may be determined on the basis of the information on the image which is read in by the photoelectric element.

This invention is not solely embodied in a copying apparatus. In an image forming apparatus such as a printer or a facsimile, this invention can be embodied by effecting the detection of the ratio of the dark part of the image to be printed on the basis of the data of image or the date of letters to be introduced from an external device.

In the present invention, the toner concentration is determined by detecting the permeability of the developer inside the developing device by means of a magnetic sensor. This invention is similarly applicable to the so-called AIDC type copying apparatus which is operated by a procedure comprising the steps of exposing the reference density pattern disposed in the neighborhood of the document table thereby forming a latent image of the pattern on a photosensitive drum, developing the latent image, then optically detecting the density of the developed image, and executing the actual toner replenishment when the value of this detection is not higher than the reference value.

This invention can also be embodied in an apparatus which is operated by a procedure comprising the steps of detecting the amount of the toner in the developing device and executing the actual replenishment of the toner on the basis of the result of this detection.

Now, another embodiment of this invention illustrated in FIGS. 13 to 16 will be described below. This embodiment shares the basic configuration with the embodiment so far described. The common basic configuration, therefore, needs no detailed description.

This embodiment allows expeditious control of the stirring of the developer and the speed of conveyance when the occurrence of the aforementioned copying condition involving quick consumption of the toner is discerned and, at the same time, the ratio of the dark part of the image on a given document exceeds the reference value.

Figure 13:
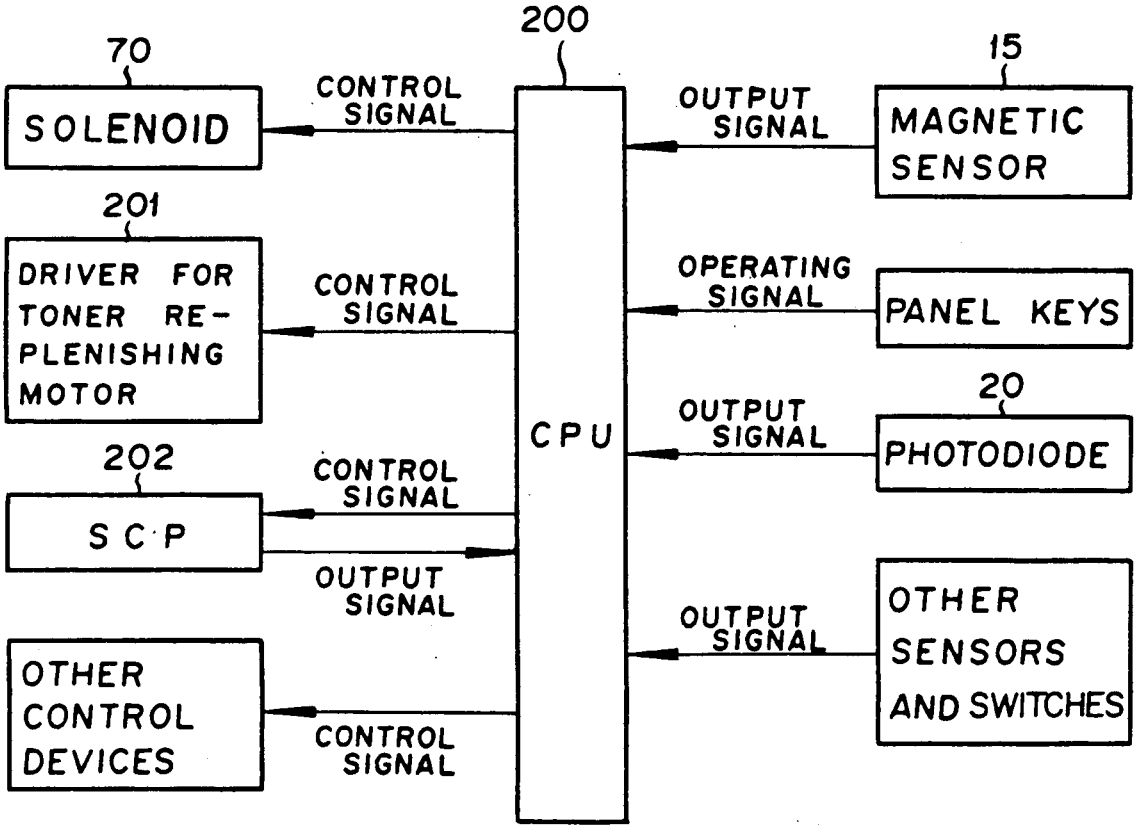
FIG. 13 is a schematic block diagram illustrating a control circuit for another typical copying machine as the second embodiment of this invention.

FIG. 13 is a diagram illustrating a control circuit for the copying apparatus of the present embodiment. As illustrated therein, the CPU 200 is so adapted as to issue an output signal additionally to a solenoid 70 adapted to alter the rotational speeds of the first screw vane 16 and the bucket roller 11.

Figure 14A:
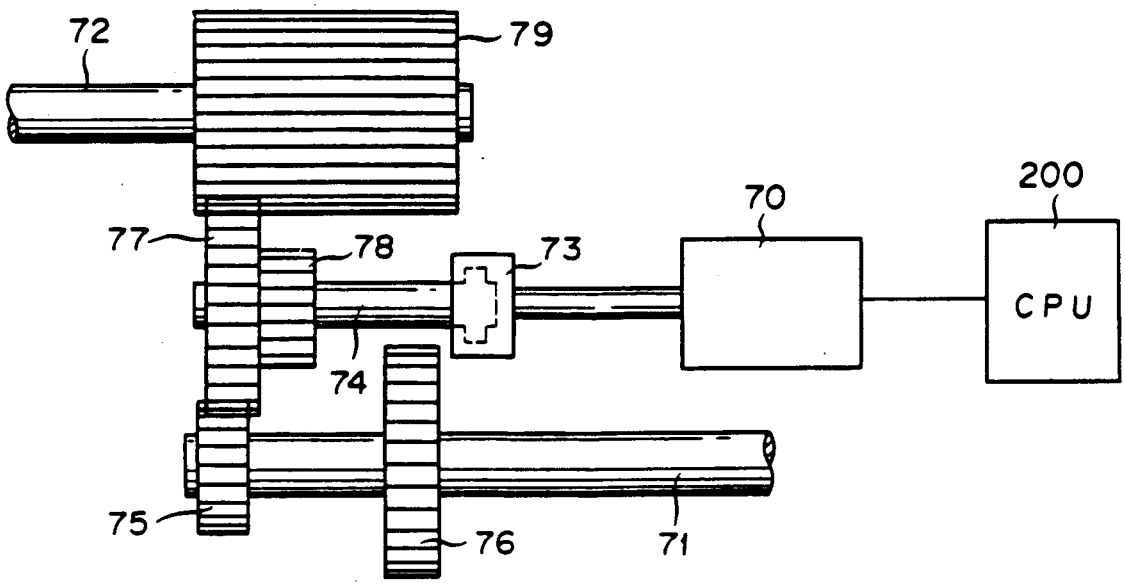
FIG. 14*a* is a front view illustrating a toner replenishing mechanism in the second embodiment adapted for quick consumption of the toner.
Figure 14B:
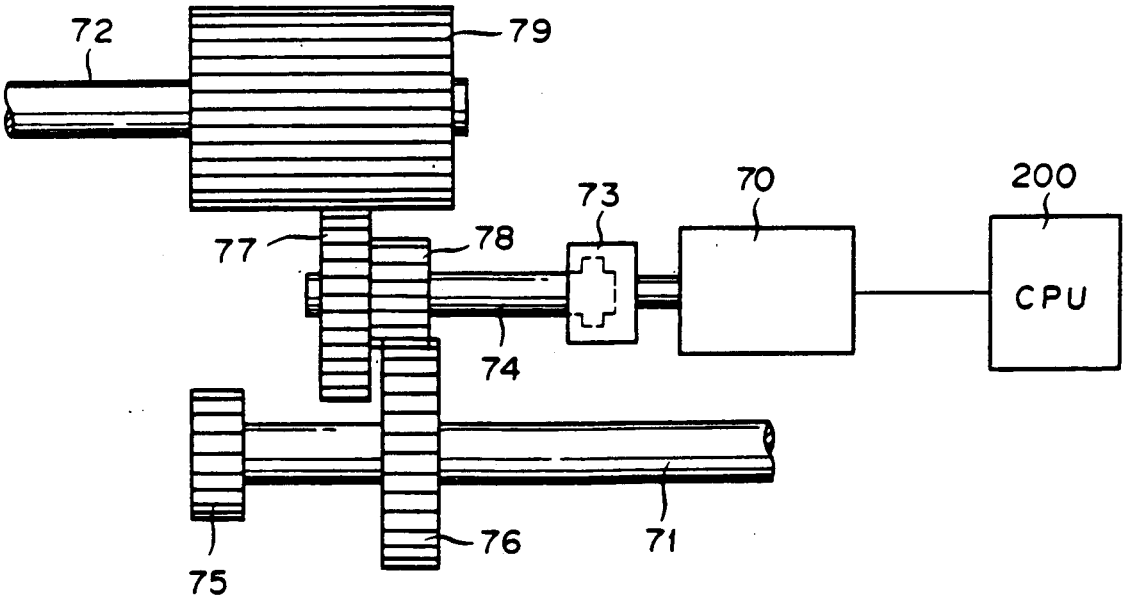
FIG. 14*b* is a front view illustrating a toner replenishing mechanism adapted for normal consumption of the toner.

FIG. 14*a* and FIG. 14*b* illustrate a mechanism for altering the rotational speeds of the first screw vane 16 and the bucket roller 11.

The driving force generated by the main motor M1 is transmitted to a shaft 71 through the medium of a transmission mechanism (not shown) so as to rotate a gear 75 and a gear 76 which are attached to the shaft 71. A gear 77 and a gear 78 are fixed on a freely rotatable shaft 74. The solenoid 70 adapted to move the shaft 74 in the axial direction is connected to this shaft 74 through the medium of a connecting part 73. The solenoid 70 is normally retained in the status of OFF as illustrated in FIG. 14*a*. In this case, the gear 77 is meshed with the gear 75. This gear 77 is always kept meshed with a gear 79. The rotation of a shaft 72 of this gear 79 is transmitted to the rotary shafts of the first screw vane 16 and the bucket roller 11. Normally, therefore, the driving force of the main motor M1 is transmitted through the shaft 71 to the gear 75, the gear 77, the gear 79, and the shaft 72 so as to drive the first screw vane 16 and the bucket roller 11.

When the CPU 200 discerns the occurrence of the condition involving quick consumption of the toner, the solenoid 70, on receiving the signal indicating this fact from the CPU 200, assumes the status of ON as illustrated in FIG. 14*b*. As a result, the shaft 74 is moved in the righthand direction in the bearings illustrated to separate the gear 77 from the gear 75 and, conversely, bring the gear 78 into mesh with the gear 76. In the resultant state, the driving force of the main motor M1 is transmitted via the shaft 71 to the first screw vane 16 and the bucket roller 11 through the medium of the gear 76, the gear 78, the shaft 74, the gear 79, and the shaft 72.

Here, the numbers of teeth of the gear 77, the gear 78, the gear 75, and the gear 76 represented respectively by Y1, Y2, X1, and X2 are so correlated as to satisfy the following formula:

$$(Y1/X1):(Y2/X2)=3:2$$

Thus, the shaft 72 is allowed to rotate at a rate 1.5 times the normal rate when the solenoid 70 is turned on.

This transmission gear ratio is desired to be arbitrarily set, depending on various conditions. In due consideration of the degree of toner consumption, the mechanism may be configured so as to permit the transmission gear ratio to be varied in a plurality of steps.

The details of the control effected on the copying apparatus of the present embodiment are substantially equal to those of the main flow chart of the first embodiment illustrated in FIG. 8 and are different with respect only to those of the sub-routine for the copy control at Step S3.

Figure 15:
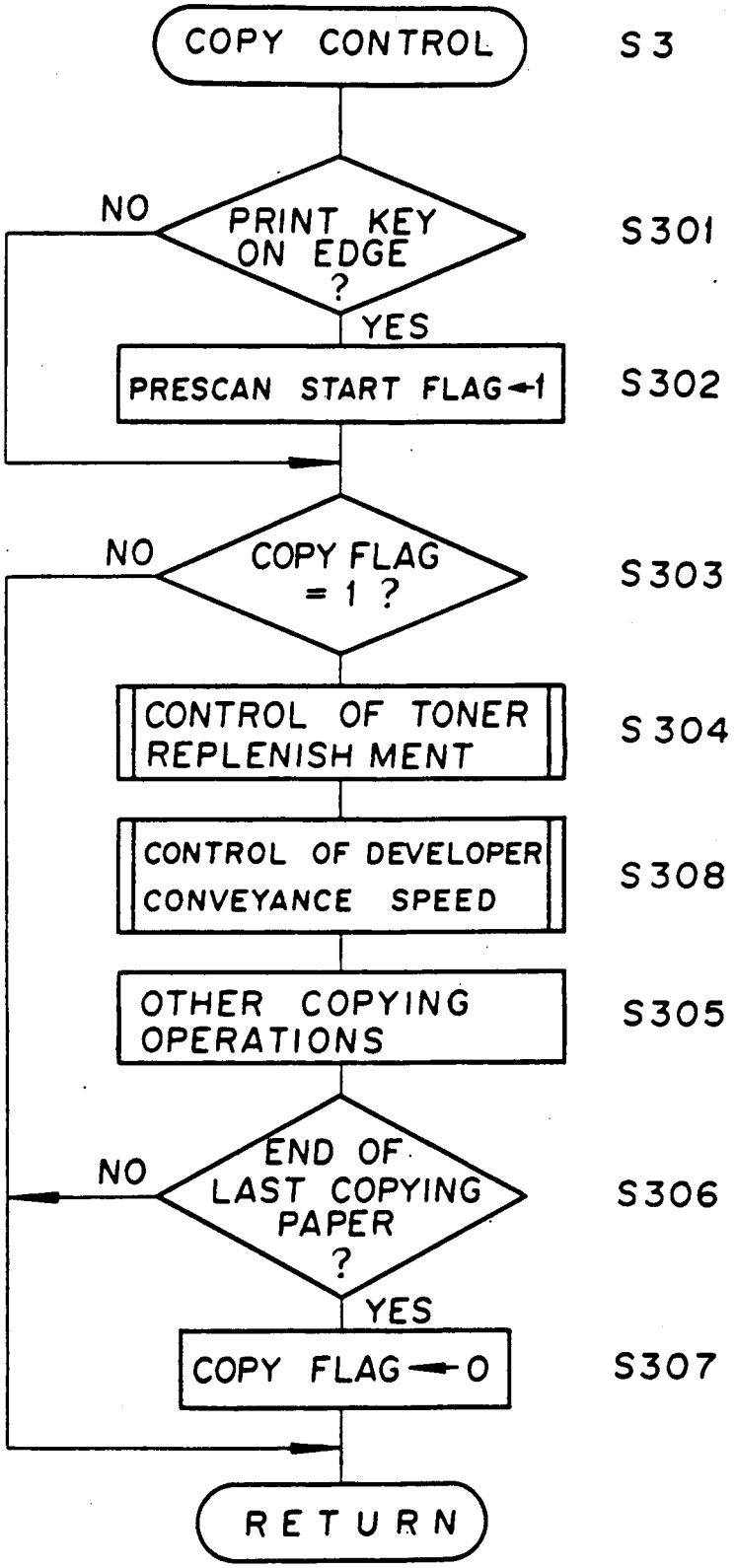
FIG. 15 is a flow chart illustrating a copy-controlling subroutine for controlling the operation of the copying machine of the second embodiment.
Figure 16:
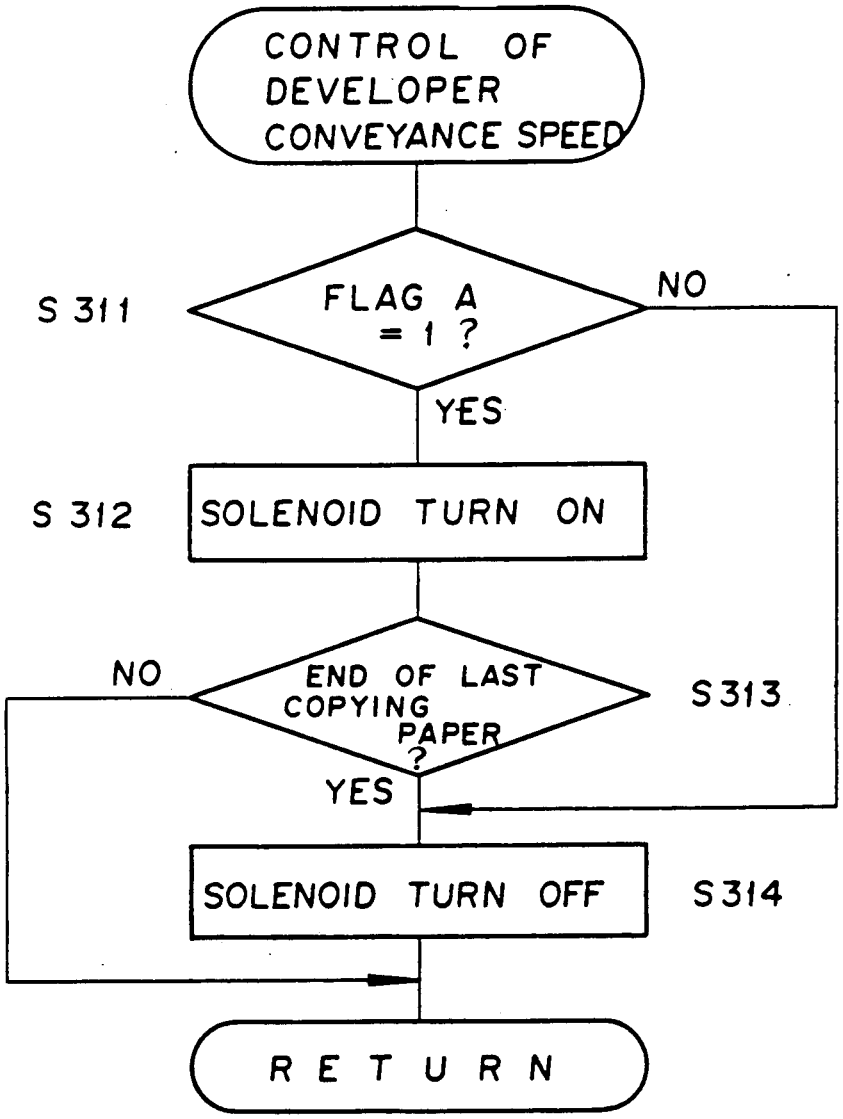
FIG. 16 is a flow chart illustrating a developer conveying rate-controlling subroutine shown in FIG. 15.

FIG. 15 is a diagram illustrating in detail the sub-routine for the copy control in the present embodiment. This sub-routine has Step S308 additionally interposed between Step S304 and Step S305 illustrated in FIG. 9. This Step S308 constitutes itself a sub-routine for the control of the speed of conveyance of the developer as described specifically herein below. The sub-routine is illustrated in detail in FIG. 16. As illustrated in FIG. 16, the decision as to whether or not the flag A is set to "1" at Step S311 and, when the decision draws an affirmative answer, the solenoid 70 is turned on at Step S312 to increase the rotational speeds of the first screw vane 16 and the bucket 11. Then, when the termination of the copying on the last copy paper is discerned at Step S313, the solenoid 70 is turned off at Step S314 to lower the rotational speeds of the first screw vane 16 and the bucket 11 to their normal levels. When the flag A is judged to be set to "0" at Step S311, the operation proceeds from Step S311 to Step S314 and the solenoid 70 is turned off.

In the embodiment of FIGS. 13 to 15, when the rapid consumption of the toner is predicted, the developer is conveyed at a speed proportionately higher than the normal level as described above. Where the toner to be consumed on the surface of the photosensitive drum 1 is supplied from the area of a fixed length in the path for the conveyance of the toner to the surface of the photosensitive drum, therefore, the speed of the movement of the developer through the area of the fixed length is heightened proportionately to the speed of the consumption of the toner. Even when the toner is consumed quickly, the difference of the toner concentration in the developer at the opposite ends of the fixed length mentioned above is not widened. The inclination of density of the toner image developed in the part of the photoconductor corresponding to the area of the fixed length is restrained to a negligible degree without reference to the quickness of the toner consumption.

Further, in accordance with the present embodiment, the toner concentration in the path of conveyance of the toner to the surface of the photoconductor is uniformized even when the toner is quickly consumed. When the sensor for the detection of the toner concentration is installed in the path of conveyance, it is allowed to detect the toner concentration faithfully on a real time basis.

Further, in accordance with the present embodiment, the insufficiently charged toner which possibly occurs when the quick consumption of the toner is predicted and, consequently, the toner is supplied in a large amount within a short span of time can be precluded because the operating rate of the device for stirring the developer within the developing device is proportionately heightened.

Figure 17:
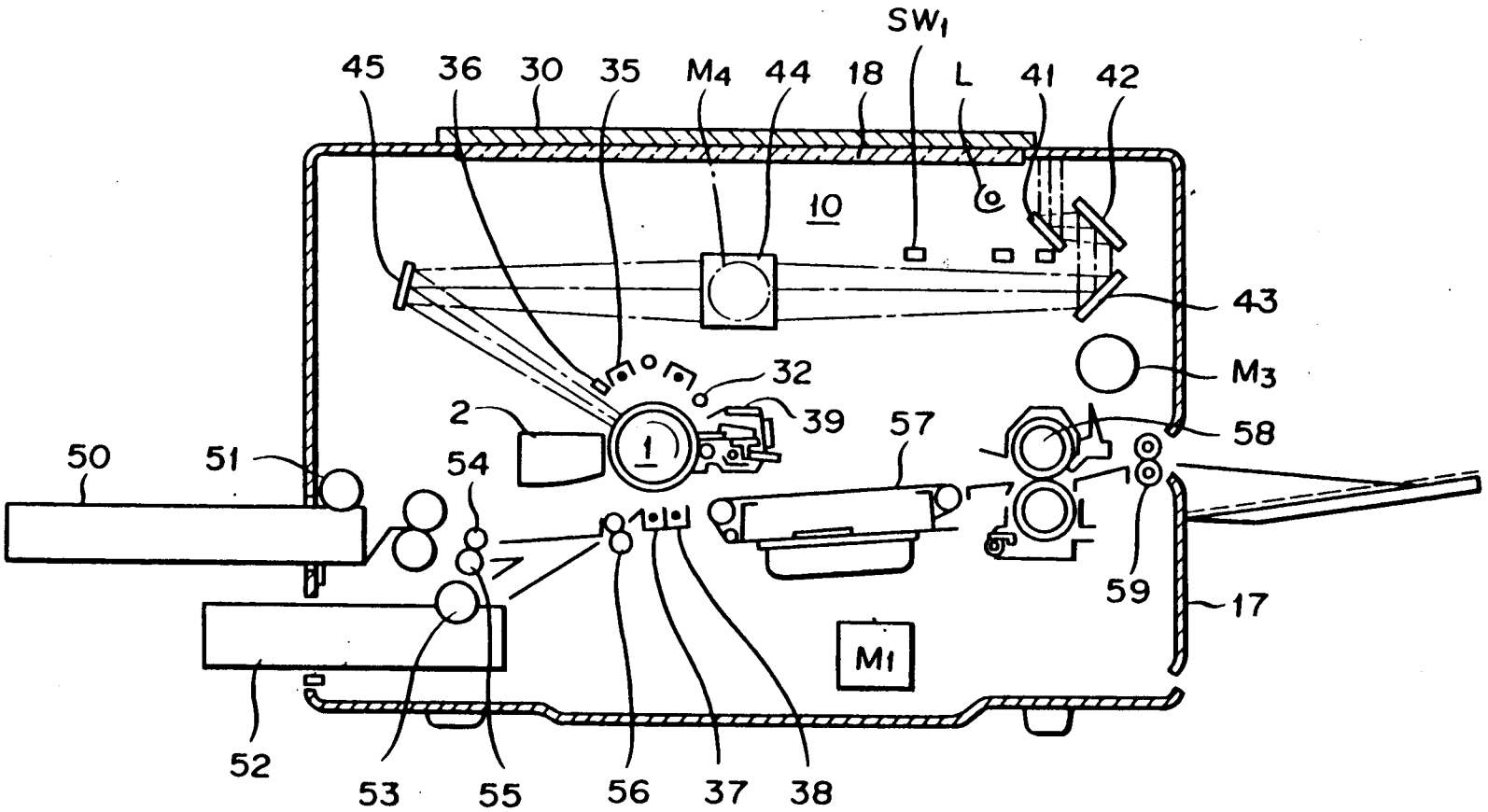
FIG. 17 is a schematic diagram illustrating the inner structure of a copying machine of the third embodiment.

Now, the third embodiment of this invention will be described below with reference to FIG. 17 and FIG. 18.

This embodiment aims to shorten the cycle of the timing of the toner replenishment when the copying condition to be set by the manipulation of the keys installed on the operation panel is judged to involve the aforementioned quick consumption of the toner and, at the same time, the ratio of the dark part of the image on the document exceeds the reference value. To be specific, the timing of the replenishment of the toner is normally set so that the actual replenishment of the toner is carried out once for each round of the scanning of the document. The replenishment of the toner is effected on this timing when the toner concentration in the developer is below the reference value. The timing of the replenishment of the toner is controlled so that the actual replenishment of the toner is carried out twice per round of the scanning of the document when the copying condition involving quick consumption of the toner is set and, at the same time, the ratio of the dark part of the image of the document exceeds 4%.

The mechanical configuration of the present embodiment is substantially similar to that of the first embodiment described above, excepting a switch SW1 is disposed at a level lower than the document table 18 and at a position incapable of interfering with the movement of the optical system. When the scanning system composed of a light source L and a movable mirror 41 are in motion, this switch SW1 is turned on once each during the scanning of the document and during the return of the scanning system to its home position.

The control circuit of the present embodiment is identical with that of the first embodiment illustrated in FIG. 7, excepting the signal to be fed into the CPU 200 includes the signal from the switch SW1.

The details of the control which is effected in the CPU 200 of the present embodiment is identical with that of the first embodiment, except for the sub-routine for the control of the toner replenishment illustrated in FIG. 12.

Figure 18:
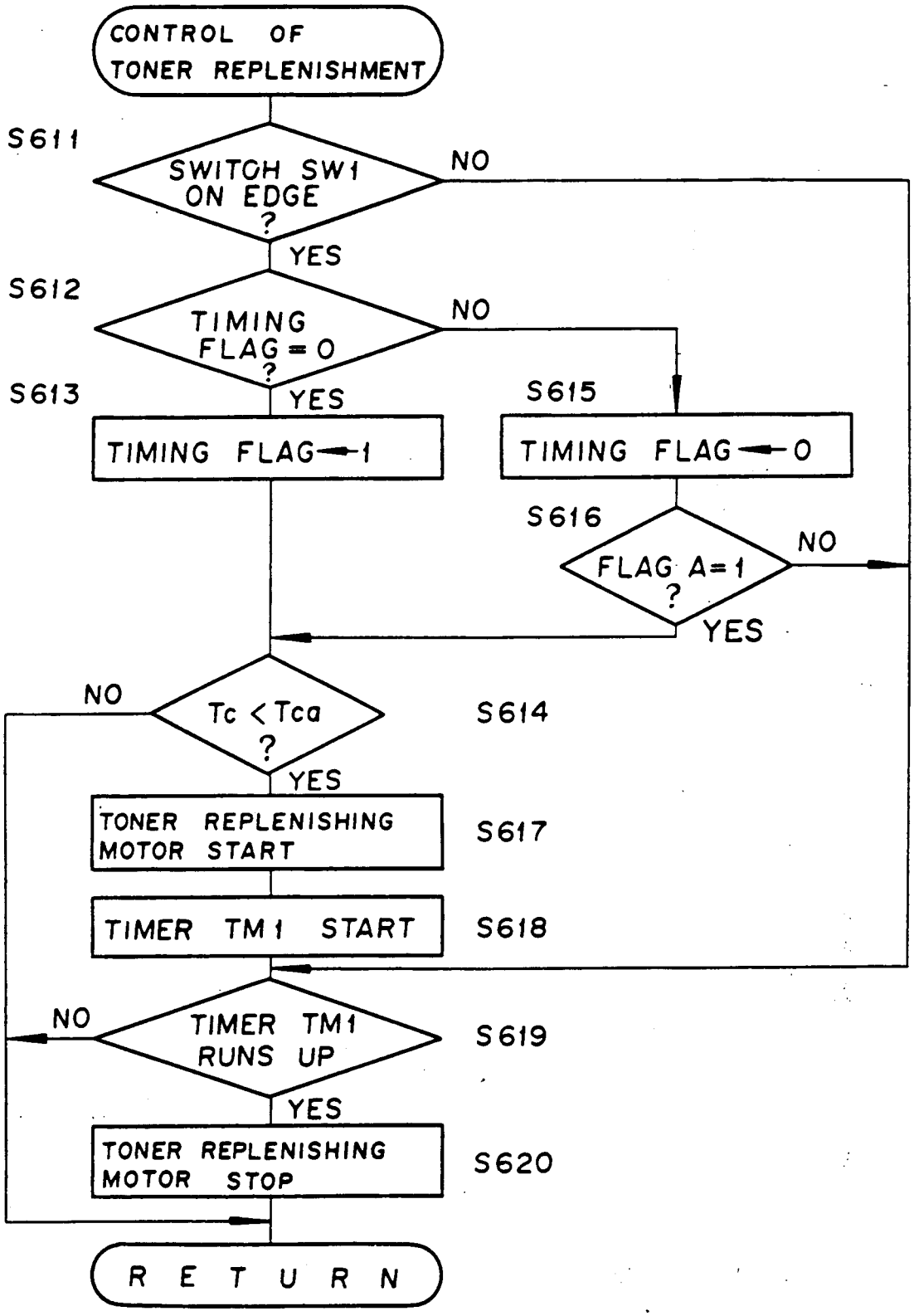
FIG. 18 is a flow chart illustrating a toner replenishment-controlling subroutine for controlling the operation of the copying machine shown in FIG. 17.
Figure 19:
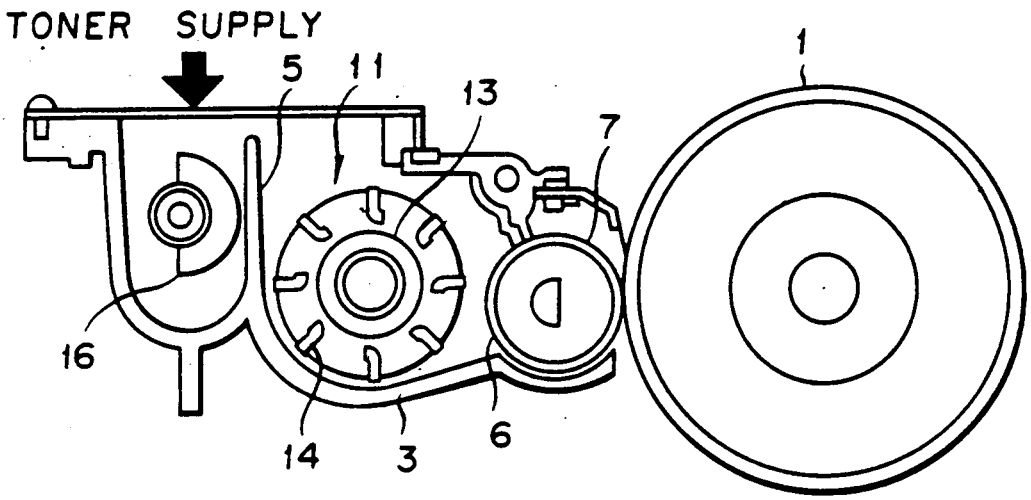
FIG. 19 (RELATED ART)
FIG. 19 is a schematic diagram illustrating the inner structure of a developing device of the related art relating to this invention, using a two-component developer.
Figure 20:
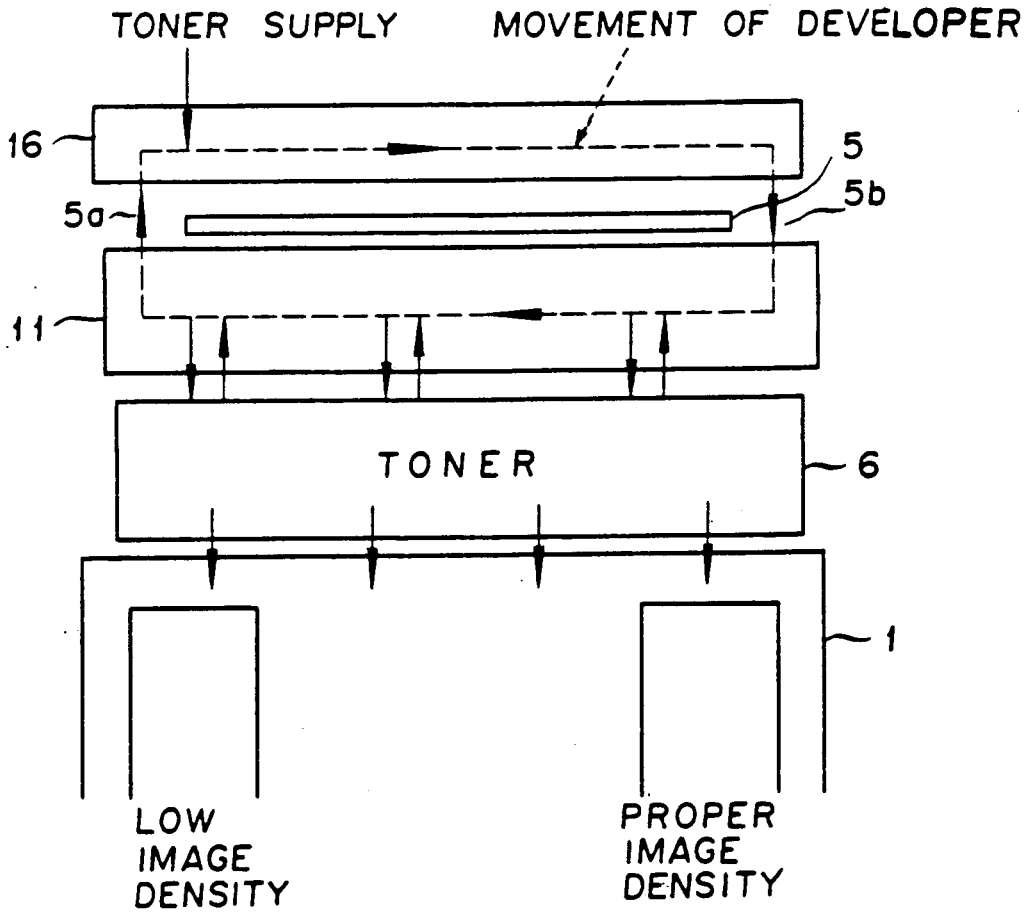
FIG. 20 is a model diagram illustrating the movement of the developer within the developing device and the consumption of the toner.

FIG. 18 is a flow chart illustrating in detail the control of the toner replenishment in the present embodiment.

First, the decision as to whether or not the switch SW1 has been turned on is made at Step S611. When this decision is in the affirmative, the decision as to whether or not the timing flag is set to "0" is made at Step S612. This timing flag is changed from "1" to "0" or from "0" to "1" each time the switch SW1 is turned on. When the timing flag is set at "0", namely when the scanning of the document is in process at Step S612, the timing flag is changed to "1" at Step S613 and the operation proceeds to Step S614. When the timing flag is set to "1", namely when the switch SW1 is turned on during the course of return at Step S612, the timing flag is changed to "0" at Step S615 and the decision as to the flag A is executed at Step S616. When the flag A is set to "1", the processing of Step S614 is executed. When the flag A is set to "0", the operation proceeds to Step S619.

At Step S614, the toner concentration, Tc, in the developer which is detected by the magnetic sensor 15 is compared with the reference toner concentration, Tca. When this comparison finds the toner concentration, Tc, to be smaller than the reference toner concentration, the toner replenishing motor is set operating to start the replenishment of the toner at Step S617 and, at the same time, the timer TM1 is started at Step S618. This timer TM1 functions to regulate the time for the operation of the toner replenishing motor. The toner of a specified amount of 200 mg is replenished by the toner replenishing motor operating until this timer TM1 runs up. The termination of the operation of this timer TM1 is judged at Step S619. When the termination is discerned, the toner replenishing motor is stopped at Step S620.

As described above, in the present embodiment, the decision on the toner concentration is executed normally once per round of the scanning of the document and, when the flag A is set as "1", once each during the scanning of the subject copy and during the return of the scanning system to the home position. Where the toner is quickly consumed, therefore, the control of the toner replenishment is executed twice per round of the scanning of the subject copy. Thus, the otherwise possible extreme fall of the toner concentration can be prevented.

As described above, in the present embodiment, the cycle of the toner replenishment is differentiated when the toner is quickly consumed and when the quick consumption of the toner is not involved. In other words, the cycle of the toner replenishment is shortened when the quick consumption of the toner takes place and the cycle remains to be long when the consumption of the toner is normal. Thus, the responsiveness of the toner replenishment to the toner consumption is high. Consequently, the magnitude of variation of the toner concentration from the reference value is proportionately small. Where the amount of the toner to be consumed shows no sharp increase as usual, the toner replenishment takes place in a longer cycle. Since the developer is thoroughly stirred before it is subjected to the judgment of toner concentration, therefore, the replenishment of the toner can be carried out in accordance with the results of more accurate detection of the toner concentration.

In the present embodiment, the area ratio of the dark part to the bright part of the image of the original document is detected so as to estimate the amount of toner to be consumed for copying the image of the document. Therefore, it may be possible to directly detect the area of image or dark part of the document.

It is preferable to precisely detect the area ratio of the dark part of the image by using a sensor of C C D (Charged Coupled Device), etc., which emits electrical signals. It is possible enough to roughly detect the ratio as in the embodiments described.

What is claimed is:

1. A toner replenishing device for use in an image forming apparatus comprising:

a developing device for developing an electrostatic latent image formed on an image carrying medium with a two-component developer consisting of a toner and a carrier, toner concentration detecting means for detecting the toner concentration of said developer in said developing device, toner replenishing means for replenishing said developing device with said toner in at least two modes, image area detecting means for detecting an area substantially corresponding to an imaged portion of an image to be printed, first controlling means for controlling said toner replenishing means to replenish the toner in the first mode when said toner concentration is below a prescribed reference value, and second controlling means for controlling said toner replenishing means to replenish the toner in the second mode when a condition of said image forming apparatus fulfils a prescribed condition which corresponds to setting of an operation mode which causes consumption of said toner in a larger amount than usual per unit time, and when the area of the imaged portion exceeds a prescribed area.

2. A toner replenishing device for use in an image forming apparatus comprising:

a developing device for developing an electrostatic latent image formed on an image carrying medium with a two-component developer consisting of a toner and a carrier, toner concentration detecting means for detecting the toner concentration of said developer in said developing device, toner replenishing means for replenishing said developing device with said toner in at least two modes, image area detecting means for detecting an area substantially corresponding to an imaged portion of an image to be printed, first controlling means for controlling said toner replenishing means to replenish the toner in the first mode when said toner concentration is below a prescribed reference value, and second controlling means for controlling said toner replenishing means to replenish the toner in the second mode when a condition of said image forming apparatus fulfils a prescribed condition which corresponds to setting of an operation mode for consuming said toner during a continuous operation in a larger amount than usual, and when the area of the imaged portion exceeds a prescribed area.

3. A toner replenishing device for use in an image forming apparatus comprising:

a developing device for developing an electrostatic latent image formed on an image carrying medium with a two-component developer consisting of a toner and a carrier, toner concentration detecting means for detecting the toner concentration of said developer in said developing device, toner replenishing means for replenishing said developing device with said toner in at least two modes, image area detecting means for detecting an area substantially corresponding to an image portion of an image to be printed, first controlling means for controlling said toner replenishing means to replenish the toner in the first mode when said toner concentration is below a prescribed reference value, and second controlling means for controlling said toner replenishing means to replenish the toner in the second mode when a condition of said image forming apparatus fulfils a prescribed condition which includes the operation of continuous printing to be effected on a larger number of copying papers than a prescribed number, and when the area of the imaged portion exceeds a prescribed area.

4. A toner replenishing device for use in an image forming apparatus comprising:

a developing device for developing an electrostatic latent image formed on an image carrying medium with a two-component developer consisting of a toner and a carrier, toner concentration detecting means for detecting the toner concentration of said developer in said developing device, toner replenishing means for replenishing said developing device with said toner in at least two modes, image area detecting means for detecting an area substantially corresponding to an imaged portion of an image to be printed, first controlling means for controlling said toner replenishing means to replenish the toner in the first mode when said toner concentration is below a prescribed reference value, and second controlling means for controlling said toner replenishing means to replenish the toner in the second mode when a condition of said image forming apparatus fulfils a prescribed condition which is the case where the printing is effected on copying papers of a size larger than the prescribed size, and when the area of the imaged portion exceeds a prescribed area.

5. A toner replenishing device for use in an image forming apparatus comprising:

a developing device for developing an electrostatic latent image formed on an image carrying medium with a two-component developer consisting of a toner and a carrier, toner concentration detecting means for detecting the toner concentration of said developer in said developing device, toner replenishing means for replenishing said developing device with said toner in at least two modes, image area detecting means for detecting an area substantially corresponding to an imaged portion of an image to be printed, first controlling means for controlling said toner replenishing means to replenish the toner in the first mode when said toner concentration is below a prescribed reference value, and second controlling means for controlling said toner replenishing means to replenish the toner in the second mode when a condition of said image forming apparatus fulfils a prescribed condition and when the area of the image portion exceeds a prescribed area, wherein the amount of said toner to be replenished per round of the toner replenishing operation which is controlled by said second controlling means is smaller than that per round of the toner replenishing operation which is controlled by said first controlling means.

6. A copying machine comprising:

a document table for supporting a document, means for forming on a photosensitive medium an electrostatic latent image of a document mounted on said document table, a developing device for developing said electrostatic latent image with a developer containing a toner, image ratio detecting means for detecting the ratio of a dark part to a bright part of the image of said document mounted on document copy table, toner concentration detecting means for detecting the toner concentration in said developer within said developing device, toner replenishing means for replenishing said developing device with said developer, setting means for setting said copying machine in an operation mode, first controlling means for controlling said toner replenishing means so as to effect the replenishment of said toner when said toner concentration is below a prescribed reference value, and second controlling means for causing said toner replenishing means to perform the operation of toner replenishment without reference to said toner concentration when the set mode obtained by said setting means equals to the prescribed operation mode and, at the same time, the ratio of the dark part of said image exceeds the prescribed reference ratio.

7. A copying machine according to claim 6, wherein the amount of said toner to be replenished per round of the toner replenishing operation which is controlled by said second controlling means is smaller than that per round of the toner replenishing operation which is controlled by said first controlling means.

8. A copying machine according to claim 7, wherein said image ratio detecting means comprises exposure means for exposing said subject copy mounted on said document table to light and detecting means for detecting the amount of reflected light from said document.

9. A copying machine according to claim 7, wherein said prescribed operation mode is for copying one document on copying papers of a number greater than the prescribed number.

10. A copying machine according to claim 6, wherein the rate of toner replenishment in the operation of toner replenishment which is controlled by said second controlling means is equal to or less than the rate at which the toner is consumed when said subject copy whose ratio of the dark part of the image equals said reference ratio is copied in said prescribed operation mode.

11. A copying machine according to claim 10, wherein the toner replenishing operation to be controlled by said second controlling means is carried out once per round of the copying action and the amount of said toner to be replenished by one round of said toner replenishing operation is equal to or less than the amount of said toner to be consumed when said document whose ratio of the dark part of the image equals said reference ratio is copied in said prescribed operation mode.

12. An electrophotographic image forming apparatus comprising:

a developing device for developing an electrostatic latent image formed on a photosensitive medium with a two-component powdered developer consisting of a toner and a carrier, stirring means for stirring said developer within said developing device, said stirring means comprising a stirring member disposed inside said developing device and driving means for driving said stirring member, and controlling means for controlling said driving means so as to accelerate the speed at which said stirring member is driven by said driving means for causing said stirring means to stir said developer in a more expeditious manner than usual when the image forming condition of said image forming apparatus equals a prescribed condition, wherein said prescribed condition corresponds to continuous repetition of the printing action on a prescribed number of copying papers.

13. An electrophotographic image forming apparatus comprising:

a developing device for developing an electrostatic latent image on a photosensitive medium with a developer, supplying means for supplying said developer in said developing device to said photosensitive medium, conveying means for conveying said developer in said developing device along said supplying means, driving means for driving said conveying means, and switching means for switching the driving speed of said conveying means among a plurality of speeds, wherein said switching means lowers the driving speed of said conveying means when an image forming condition of said image forming apparatus fulfils a prescribed condition which is the condition which requires a large amount of said toner to be consumed by a series of copying operations.

14. An electrophotographic image forming apparatus according to claim 13, wherein said prescribed condition corresponds to setting of said image forming apparatus in a prescribed image forming mode.

15. An electrophotographic image forming apparatus according to claim 13, wherein said image forming apparatus further comprises means for detecting the ratio of a dark part to a bright part of an image to be printed and said prescribed condition corresponds to the fact that said ratio of the dark part exceeds a prescribed reference ratio.

16. A copying machine comprising:

a developing device for developing an electrostatic latent image on a photosensitive medium with a developer, image ratio detecting means for detecting the ratio of an image part to an non-image part of an image of a document, input means for effecting the input of a copying mode of said copying machine, a conveying path for circulating said developer within said developing device, conveying means for circulating said developer along said conveying path, means for supplying said developer to said photosensitive medium through said conveying path, and means for controlling said conveying means so as to accelerate the speed of conveyance of said conveying means when said copying mode introduced by said input means fulfils a prescribed copying mode and, at the same time, the ratio of the image part to the non-image part of the image of the document exceeds a prescribed reference ratio.

17. A copying machine according to claim 16, wherein said copying machine further comprises replenishing means for effecting the replenishment of said conveying path with said toner.

18. A copying machine according to claim 17, wherein said developer is a two-component developer consisting of a toner and a carrier.

19. A copying machine according to claim 16, wherein said prescribed copying mode corresponds to a specific copying mode in which a large amount of said toner is consumed in a series of copying actions.

20. A copying machine according to claim 19, wherein said prescribed copying mode includes continuous copying on a prescribed number of copying papers.

21. A copying machine according to claim 20, wherein said prescribed copying mode includes copying one document on copying papers of a number larger than a prescribed number.

22. A copying machine according to claim 16, wherein said conveying means comprises a conveying member for conveying said developer, driving means for driving said conveying member, and speed changing means for transmitting the driving force of said driving means to said conveying member and, at the same time, switching the driving speed of said conveying member among a plurality of speeds by virtue of a signal from said controlling means.

23. A copying machine according to claim 22, wherein said speed changing means comprises a plurality of pairs of gears severally possessing different gear ratios.

24. An electrophotographic image forming apparatus comprising:

a developing device for developing an electrostatic latent image formed on a photosensitive medium with a developer containing a toner, toner replenishing means for replenishing said developing device with said toner, first controlling means for controlling said replenishing means so as to effect the replenishment of said toner with a prescribed timing, image ratio detecting means for detecting the ratio of a dark part to a bright part of an image to be formed, and second controlling means for controlling said replenishing means to replenish said toner with a prescribed timing and another timing when an operating mode of said image forming apparatus fulfils a prescribed mode and, at the same time, the ratio of the dark part of said image exceeds a prescribed reference ratio.

25. An electrophotographic image forming apparatus according to claim 24, wherein said prescribed mode corresponds to an operating mode in which a large amount of said toner is consumer per unit time.

26. An electrophotographic image forming apparatus according to claim 25, wherein said image forming apparatus further comprises setting means for setting said operating mode.

27. An electrophotographic image forming apparatus according to claim 25, wherein said image forming apparatus further comprises a document table for supporting thereon a document and scanning means for scanning said document mounted on said document table and said prescribed timing is so set as to effect the replenishment of said toner once per round of the scanning action performed by said scanning means.

28. An electrophotographic image forming apparatus according to claim 27, wherein said image forming apparatus further comprises scanner detecting means for detecting the fact that said scanning means is located at a prescribed position and said controlling means effects the control of said replenishing means in accordance with a result of the detection by said scanner detecting means.

29. An electrophotographic image forming apparatus according to claim 28, wherein said scanner detecting means is a microswitch for detecting the fact that said scanning means has arrived at a prescribed position.

30. An electrophotographic image forming apparatus according to claim 29, wherein said prescribed timing is the detection of said scanning means by said microswitch during the course of forward travel of said scanning means and said another timing is the detection of said scanning means by said microswitch during the course of backward travel of said scanning means.

31. An electrophotographic image forming apparatus comprising:

a developing device for developing an electrostatic latent image on a photosensitive medium with a developer, toner concentration detecting means for detecting the toner concentration in said developer within said developing device, means for, judging with a prescribed cycle as to whether or not said toner concentration is not more than a prescribed referenced value, replenishing means for replenishing said developing device with said toner when said toner concentration determined in consequence of said decision made by said judging means is not more than said prescribed reference value, image ratio detecting means for detecting the ratio of a dark part to a bright part of an image to be formed, and controlling means for causing the cycle of said decision made by said judging means to be smaller than usual when the operating condition in said image forming apparatus fulfils a prescribed condition and, at the same time, the ratio of the dark part of said image is not less than a prescribed reference value.

32. An electrophotographic image forming apparatus according to claim 31, wherein said prescribed condition corresponds to a continuous formation of said image on a prescribed number of copying papers.

33. An electrophotographic image forming apparatus according to claim 31, wherein the normal cycle of said decision made by said judging means is identical with the cycle of image formation wherein said image formation is effected continuously on a plurality of copying papers.

34. A copying machine comprising:

a document table for supporting in place a document, scanning means for scanning the image on said document by traveling along said document mounted on said document table, means for forming on a photosensitive medium an electrostatic latent image of said image scanned by said scanning means, a developing device for developing an electrostatic latent image on a photosensitive medium with a developer, toner concentration detecting means for detecting the toner concentration in said developer within said developing device, replenishing means for replenishing said developing device with said toner, toner replenishment controlling means for controlling said replenishing means in accordance with the result of said detection made by said toner concentration detecting means, a microswitch for detecting the fact that said scanning means has arrived at a prescribed position, and toner concentration detecting and controlling means for effecting the detection mace by said toner concentration detecting means normally when the detection by said microswitch is made during forward travel of said scanning means or when the detection by said microswitch is made during forward travel and backward travel of said scanning means where a copying condition fulfils a prescribed condition.

35. Electrophotographic image forming means comprising:

a developing device for developing an electrostatic latent image on a photosensitive medium with a developer, replenishing means for replenishing said developing device with said toner, means for detecting the ratio of an image part to a non-image part of an image to be printed, means for setting the number of copying papers to be continuously printed, and controlling means for actuating said toner replenishing means when the number of copying papers set by said setting means exceeds a prescribed reference number and, at the same time, the ratio of the image part to the non-image part exceeds a prescribed ratio.

36. A electrophotographic image forming apparatus comprising:

a developing device, toner concentration detecting means for detecting the toner concentration in developer within said developing device, replenishing means for replenishing said developing device with the toner when the toner concentration detected by said toner concentration detecting means is not more than a prescribed reference value, image area detecting means for detecting an area of the dark part of an image to be formed, setting means for setting said image forming apparatus in a prescribed operating mode, and controlling means for controlling said replenishing means so that the number of the toner replenishment during a prescribed time is more than usual when the image forming apparatus is set in the prescribed operating mode and when the area of the dark part of the image exceeds a prescribed reference value.

37. A method for controlling toner concentration of developer in an electrophotographic image forming apparatus which has a developing device and setting means for setting the apparatus in a prescribed operating mode, said method comprising:

detecting the toner concentration of developer in the developing device;

replenishing the developing device with the toner when the toner concentration is below a prescribed reference value;

detecting the ratio of a dark part to a bright part of an image to be printed; and replenishing the developing device with the toner when said apparatus is set in the prescribed operating mode and when the ratio of the dark part to the bright part of the image exceeds a prescribed ratio.

38. An electrophotographic image forming apparatus comprising:

a developing device for developing an electrostatic latent image formed on a photosensitive medium with a powdered two-component developer consisting of a toner and a carrier, stirring means for stirring said developer within said developing device, said stirring means comprising a stirring member disposed inside said developing device and driving means for driving said stirring member, and controlling means for controlling said driving means so as to accelerate the speed at which said stirring member is driven by said driving means for causing said stirring means to stir said developer in a more expeditious manner than usual when an image forming condition of said image forming apparatus equals a prescribed condition which corresponds to setting of an operation mode which causes consumption of said toner in a larger amount than usual per unit time.

39. An electrophotographic image forming apparatus comprising:

a developing device for developing an electrostatic latent image formed on a photosensitive medium with a powdered two-component developer consisting of a toner and a carrier, stirring means for stirring said developer within said developing device, said stirring means comprising a stirring member disposed inside said developing device and driving means for driving said stirring member, and controlling means for controlling said driving means so as to accelerate the speed at which said stirring member is driven by said driving means for causing said stirring means to stir said developer in a more expeditious manner than usual when an image forming condition of said image forming apparatus equals a prescribed condition which corresponds to setting of an operation mode for consuming said toner during a continuous operation in a larger amount than usual.

40. An electrophotographic image forming apparatus comprising:

a developing device for developing an electrostatic latent image formed on a photosensitive medium with a powdered two-component developer consisting of a toner and a carrier, stirring means for stirring said developer within said developing device, said stirring means comprising a stirring member disposed inside said developing device and driving means for driving said stirring member, and controlling means for controlling said driving means so as to accelerate the speed at which said stirring member is driven by said driving means for causing said stirring means to stir said developer in a more expeditious manner than usual when an image forming condition of said image forming apparatus equals a prescribed condition which is the case where the printing is effected on copying papers of a size larger than a prescribed size.

41. An electrophotographic image forming apparatus comprising:

a developing device for developing an electrostatic latent image formed on a photosensitive medium with a powdered two-component developer consisting of a toner and a carrier, stirring means for stirring said developer within said developing device, said stirring means comprising a stirring member disposed inside said developing device and driving means for driving said stirring member, and controlling means for controlling said driving means so as to accelerate the speed at which said stirring member is driven by said driving means for causing said stirring means to stir said developer in a more expeditious manner than usual when an image forming condition of said image forming apparatus equals a prescribed condition, said image forming apparatus further comprising means for detecting the ratio of a dark part to a bright part of an image to be printed, and wherein said prescribed condition corresponds to the fact that said ratio exceeds a prescribed reference ratio.

* * * * *

UNITED STATES PATENT AND TRADEMARK OFFICE

CERTIFICATE OF CORRECTION

PATENT NO. : 5,040,023

DATED : August 13, 1991

INVENTOR(S) : Tomoaki Yokoyama

It is certified that error appears in the above-identified patent and that said Letters Patent is hereby corrected as shown below:

In col. 1, line 46, change "know" to --known--.

In col. 3, line 20, change "a" (second occurrence) to --an--.

In col. 3, line 66, after "comprising", insert --:-- (colon).

In col. 4, line 19, after "comprising", insert --:-- (colon).

In col. 8, line 61, after "ment", insert --.-- (period).

UNITED STATES PATENT AND TRADEMARK OFFICE

CERTIFICATE OF CORRECTION

PATENT NO. : 5,040,023

DATED : August 13, 1991

INVENTOR(S) : Tomoaki Yokoyama

It is certified that error appears in the above-identified patent and that said Letters Patent is hereby corrected as shown below:

In col. 14, line 14, change "603" to --S603--.

In col. 24, line 37 (claim 25, line 4), change "consumer" to --consumed--.

In col. 25, line 9 (claim 31, line 9), delete --,-- (comma).

In col. 25, line 60 (claim 34, line 24), change "mace" to --made--.

Signed and Sealed this

Sixteenth Day of March, 1993

*Attest:*

STEPHEN G. KUNIN

*Attesting Officer*

*Acting Commissioner of Patents and Trademarks*